US006367382B1

(12) United States Patent
Imamaki et al.

(10) Patent No.: US 6,367,382 B1
(45) Date of Patent: Apr. 9, 2002

(54) STAMP MAKING DEVICE

(75) Inventors: Teruo Imamaki, Kasugai; Nachito Asai; Koji Sugiyama, both of Nagoya, all of (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/143,621

(22) Filed: Aug. 28, 1998

(30) Foreign Application Priority Data

Aug. 29, 1997 (JP) ..... 9-249981
Aug. 29, 1997 (JP) ..... 9-249982
Sep. 18, 1997 (JP) ..... 9-272208

(51) Int. Cl.[7] ..... B41K 1/56
(52) U.S. Cl. ..... 101/405; 101/333
(58) Field of Search ..... 101/405, 333, 101/336, 327, 332; 400/223, 203, 211, 216.3, 237

(56) References Cited

U.S. PATENT DOCUMENTS 3,847,077 A * 11/1974 Sirnstein et al. ..... 101/24
3,904,877 A * 9/1975 Hasegawa et al. ..... 250/317
5,111,745 A * 5/1992 Wilson ..... 101/333
5,595,112 A * 1/1997 Seo ..... 101/26
5,644,136 A * 7/1997 Kameda et al. ..... 250/492.1
5,771,803 A * 6/1998 Takami ..... 101/128.21
5,771,808 A * 6/1998 Kuriyama et al. ..... 101/401.1
6,006,661 A * 12/1999 Tukahara et al. ..... 101/16
6,016,749 A * 1/2000 Tukahara et al. ..... 101/401.1
6,047,638 A * 4/2000 Taira ..... 101/135
6,116,157 A * 9/2000 Hayama et al. ..... 101/114

FOREIGN PATENT DOCUMENTS

EP 0 698 498 A2 2/1996
EP 0 698 498 A3 5/1997

* cited by examiner

*Primary Examiner*—Daniel J. Colilla
*Assistant Examiner*—Darius N. Cone
(74) *Attorney, Agent, or Firm*—Pitney, Hardin, Kipp & Szuch LLP

(57) ABSTRACT

A stamp making device includes (1) a data input unit, (2) an original printing unit which forms an original film by printing an image on a transparent film based on inputted image data, (3) an irradiation unit including a transparent support plate and a light source, (4) an original feeder which feeds the original film on the transparent support plate, and (5) a biasing unit which biases the porous resin member against the original film on the transparent support plate. The irradiation unit applies the light to the porous resin member through the original film, in a state the porous resin member is biased to the original film by the biasing unit, so that an irradiated portion of the porous resin member is melted.

21 Claims, 21 Drawing Sheets

IRRADIATION PROCESS
S110
ORIGINAL FILM SET?
NO
YES
S120
STAMP SET?
NO
YES
S130
STAMP SIZE OK?
NO
YES
S140
LIDS CLOSED?
NO
YES
S150
BIASSING OK?
NO
YES
S160
CONDENSER CHARGED?
NO
S170
XENON TUBE IRRADIATION
S180
XENON TUBE IRRADIATION PROHIBIT
RETURN

STAMP MAKING DEVICE

Background of the Invention

This invention relates to a stamp making device which makes a printing plate from a porous resin member.

As disclosed in U.S. Pat. No. 5,644,136, a conventional stamp making device includes an irradiation unit that applies ultraviolet rays to a resin member which is sensitive to ultraviolet rays. The stamp making device further includes an original printing unit that prints an image on a film by means of a thermal head, thereby to make an original film having a desired image. The original film is provided between the resin member and the irradiation unit. Irradiated portions of the resin member are cured, while non-irradiated portions of the resin member are not cured. The non-irradiated (non-cured) portions of the resin member are removed by a washing process, so that the irradiated (cured) portions remain on the resin member as projections.

However, such a conventional stamp making device has a disadvantage such that the operation is complicated, since the washing process is necessary. Further, in order to avoid unintentional irradiation of the resin member, the resin member should be stored in a lightproof case.

Further, there is a possibility that an user mistakenly operates the stamp making device without setting the original film thereon. In such a case, a waste printing plate may be made. Thus, there is a strong demand for a stamp making device in which an operation under insufficient condition is prohibited.

SUMMARY OF THE INVENTION

It is therefore an object of the present invention to provide a stamp making device wherein a stamp making process is simple.

Further, it is another object of the present invention to provide a stamp making device in which an operation under insufficient condition is prohibited.

According to one aspect of the present invention, there is provided a stamp making device including (1) a data input unit into which image data is inputted, (2) an original printing unit including a thermal head and a platen which nip a transparent film and an ink ribbon therebetween, the thermal head being driven to print an image on the transparent film based on the image data, thereby to make an original film, (3) an irradiation unit including a transparent support plate and a light source, (4) an original feeder which feeds the original film to the transparent support plate, and (5) a biasing unit which biases the porous resin member to the original film on the transparent support plate. The irradiation unit applies light to the porous resin member through the original film, in a state the biasing unit biases the porous resin member to the original film, so that an irradiated portion of the porous resin member is melted.

With such an arrangement, an irradiated portion of the porous resin member is melted and solidified, while non-irradiated portion of the porous resin member remains elastic. When the biasing force is removed, the non-irradiated portion of the porous resin member recovers its original thickness, while the irradiated (solidified) portion of the porous resin member remains the same as it is biased. Thus, the non-irradiated portion of the porous resin member becomes a projection. Stamp ink impregnated in the printing plate is transferred to a recording media through the projection of the printing plate.

As constructed above, since the washing process is not necessary, the stamp making operation becomes simple.

Further, since it is not necessary to store the porous resin member in a lightproof case, the porous resin member can be handled in a simple manner. Furthermore, since the stamp pattern is made according to the inputted image data, a wide variety of stamp pattern can be formed.

Particularly, the original film is laid on the transparent support plate so that a printed surface of the original film is faced with the porous resin member. With this, the image on the original film is so-called a positive image. Thus, the original printing unit is able to print the image on the original film in a similar manner that a thermal printer prints an image on a paper.

In a preferred embodiment, a width of the transparent film is greater than a width of the ink ribbon. The original printing unit further includes a feeding roller pair which nip the transparent film and the ink ribbon therebetween. One of the feeding roller pair (located at the ink ribbon side) has projections which grip both of the ink ribbon and the transparent film. Thus, the positioning error of the transparent film and the ink ribbon is prevented. Accordingly, the blurring of the printed image on the original film is prevented.

It is preferred to provide a guiding structure which guides both sides of the original film, from the original printing unit to the irradiation unit. Thus, the original film can be correctly positioned on the transparent support plate of the irradiation unit.

In a particular arrangement, the stamp making device further includes (1) a cut sheet introducing unit which introduces the cut sheet between the transparent film and the ink ribbon, and (2) a cut sheet detector which detects if the cut sheet reaches a predetermined portion where the thermal head is able to print an image on the cut sheet. When the cut sheet detector detects the cut sheet reaching the predetermined portion, the thermal head prints the image on the cut sheet. After the image is printed on the cut sheet, the cut sheet is separated from the ink ribbon and the transparent film, and discharged out of the stamp making device.

With such an arrangement, a label (having the same pattern as the printing plate) can be easily made. The label is attached on a top portion of the stamp, so that a user can easily recognize the pattern of the stamp.

Preferably, the cut sheet introducing unit feeds the cut sheet at a lower speed compared with a feeding speed of the transparent film and the ink ribbon. Thus, tension is applied on the cut sheet. In one case, it is possible to provide a separating unit which separates the cut sheet from the ink ribbon and the transparent film. Preferably, a separation angle of the cut sheet from each of the ink ribbon and the transparent film is not less than 45 degrees.

In another preferred embodiment, the stamp making device further includes (1) a body including fixed and openable frames opposing with each other, the openable frame being swingable, (2) a ribbon cassette accommodating the ink ribbon, (3) a film cassette accommodating the transparent film, (4) a ribbon cassette mounting portion provided in the body, which has at least one shaft extending from the fixed frame toward the openable frame, and (5) a film cassette mounting portion provided in the body, which has at least one shaft extending from the fixed frame toward the openable frame. When the openable frame is closed, each of the shafts of the mounting portions is supported at both ends thereof by the fixed and openable frames.

With such an arrangement, the cassettes can be easily mounted to and detached from the stamp making device, by opening the openable frame and by pushing/pulling the cassettes along the shafts.

It is preferred to further provide (1) an arrangement which moves the platen toward and away from the thermal head thereby to nip and release the ink ribbon and the transparent film, and (2) a lock mechanism which locks the openable frame to prohibit the openable frame from opening when the platen is toward the thermal head.

In another preferred embodiment, the stamp making device further includes (1) a first detector which detects if the original film is set on the irradiation unit, (2) a second detector which detects if the porous resin member is set on the irradiation unit, (3) a third detector which detects if the porous resin member is biased, and (4) an irradiation prohibit unit which prohibits the irradiation of the light source, when a negative result is obtained from any of the detectors. Therefore, an operation under insufficient condition (for example, when the stamp is not mounted) is prevented.

Optionally, the light source is a xenon tube. In such a case, it is preferred that the irradiation prohibit unit prohibits the irradiation when charging of the xenon tube is not completed. Further, the irradiation unit includes a cover which prevents a leakage of light. The irradiation prohibit unit prohibits the irradiation of the light source when a cover is not closed. With this, a user is protected from the light.

It is preferable to further provide a stamp size detector which detects a size of the stamp mounted on the stamp making device. The stamp size detector determines if the stamp size is suitable for the original film. Thus, when a porous resin member is too small (or large) compared with the original film, the operation of the stamp making device is prevented. Thus, a waste printing plate is not generated.

In another particular arrangement, a transparent sheet is provided between the porous resin member and the printed image of the original film. The thickness of the transparent sheet is not less than 0.019 mm.

In the stamp making device, the original film is laid on a transparent support plate made of acrylic resin or the like. When the printed image of the original film is heated, the heat may be transmitted to the support plate.

However, since the transparent sheet (not less than 0.019 mm in thickness) exists between the transparent support plate and the printed image, the heat of the printed image is diffused in the transparent sheet. Thus, the heat damage to the transparent support plate is prevented. Advantageously, the thickness of the transparent sheet is not less than 0.025 mm.

It is preferable that the original film is made of a transparent film not less than 0.019 mm in thickness with a black image being printed thereon. The original film is laid on the transparent support plate so that the printed image is faced with the porous resin member. With this, the transparent film of the original film acts as the above-described transparent sheet. Thus, the heat damage of the transparent support plate is prevented, without providing a separate transparent sheet. Advantageously, the thickness of the transparent film of the original film is not less than 0.025 mm.

Further, the transparent support plate is made of acrylic plastic. The transparent sheet is made of polyethylene terephthalate. Since the melting point of polyethylene terephthalate is higher than the melting point of the porous resin, the transparent sheet itself is not damaged by heat.

In one case, the porous resin member is made of polyurethane resin including 0.1 to 15 wt % carbon black. The light source is a xenon tube which is strong enough to melt the porous resin member. With this, an irradiated portion of the porous resin member is melted and solidified. Although the printed image (ink image) on the original film is also heated by the irradiation of the xenon tube, the heat of printed image is diffused in the transparent film. Thus, the heat damage to the transparent support plate is prevented. The xenon tube has an advantage such that the irradiation energy can be easily adjusted. Further, different from a flash bulb, it is not necessary to replace the xenon tube at every irradiation.

DESCRIPTION OF THE PREFERRED EMBODIMENT

The embodiments of the present invention are described with reference to the accompanying drawings.

A Stamp

Figure 1B:
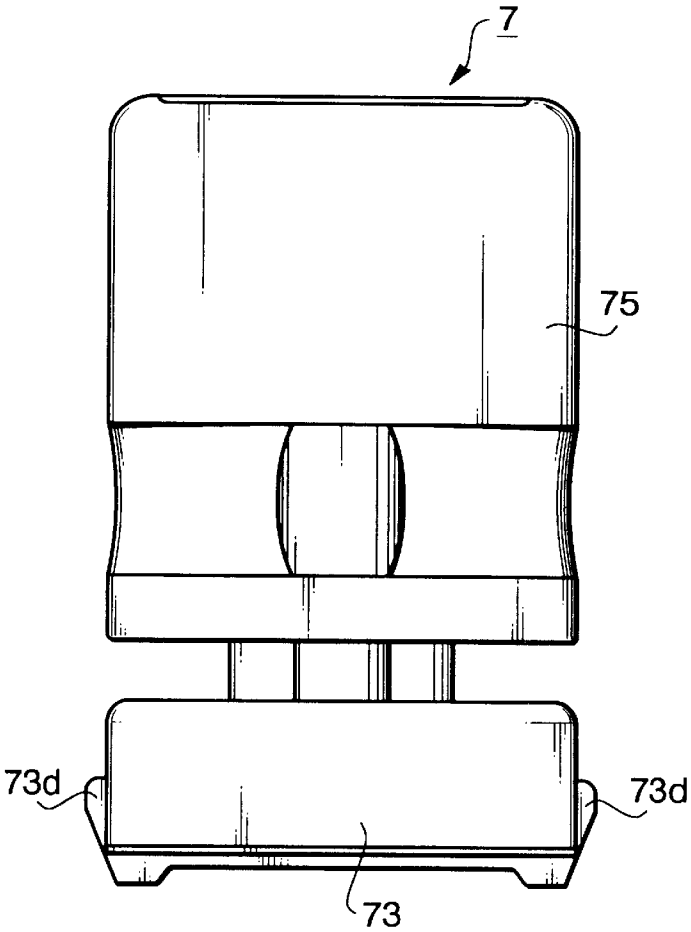
FIGS. 1A and 1B are a sectional view and a front view of a stamp according to a first embodiment of the present invention.
Figure 1A:
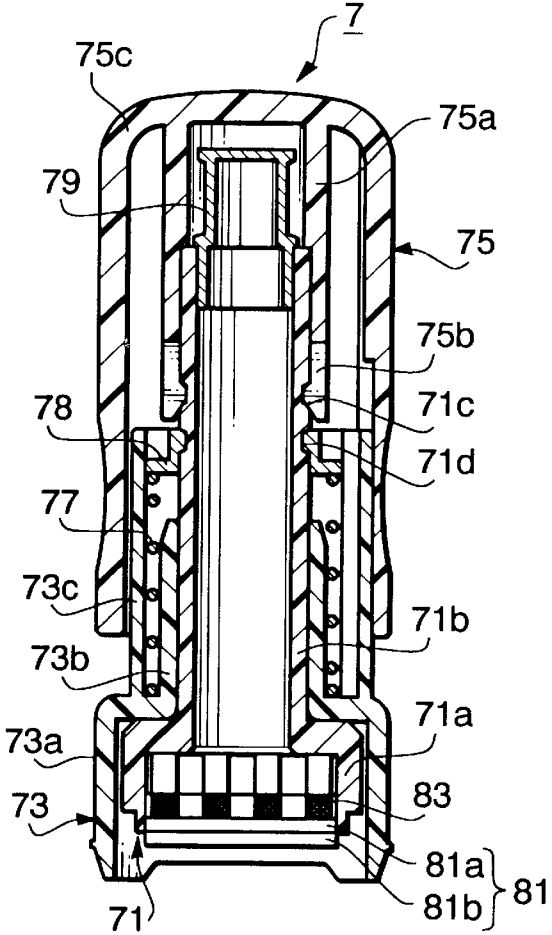

First, a stamp 7 of the first embodiment is described. FIGS. 1A and 1B are a sectional view and a front view of the stamp 7. As shown in FIG. 1A, the stamp 7 includes a resin member 81, a holder 71 which supports the resin member 81, a skirt 73 provided around the holder 71 and a grip 75 which is to be gripped by a user. The resin member 81 has a double-layered structure and includes upper and lower layers 81*a* and 81*b*. The upper layer 81*a* is made of hard porous resin such as polyvinyl formal. The lower layer 81*b* is made of flexible porous resin such as polyurethane resin. Carbon black or other light-energy-absorbing-material is dispersed in the lower layer 81*b*.

The holder 71 includes a box-shaped holder body 71*a* and a support cylinder 71*b* extended upward from the holder body 71*a*. The resin member 81 is mounted to the holder body 71*a* via a spacer 83. The support cylinder 71*b* has two laterally extending grooves 71*c* and 71*d*. The top end of the support cylinder 71*b* is sealed by a cap 79.

The skirt 73 includes a skirt body 73*a* and inner and outer cylinders 73*b* and 73*c* extended upward from the skirt body 73*a*. The skirt body 73*a* is so constituted that the holder body 71*a* of the holder 71 is inserted therein. The inner cylinder 73*b* is so constituted that the support cylinder 71*b* is inserted therein. A coil (compression) spring 77 is provided between the inner and outer cylinders 73*b* and 73*c*. The top of the coil spring 77 abuts a ring member 78 provided around the support cylinder 71*b* of the holder 71, while the bottom of the coil spring 77 abuts the top surface of the skirt body 73*a*. With this, the coil spring 77 urges the skirt 73 downward with respective to the holder 71. The skirt 73 is provided with two positioning projections 73*d* (FIG. 1B) at the bottom thereof, which are described later.

The grip 75 includes an outer case 75*c* and an inner cylinder 75*a* extended downward from the top of the outer case 75*c*. The top of the outer case 75*c* has a certain curvature as shown in FIG. 1A. The inner cylinder 75*a* receives an upper portion of the support cylinder 71*b* of the holder 71. The inner cylinder 75*a* has projection 75*b* which engages the laterally extending groove 71*c* of the holder 71. Due to the engagement of the projection 75*b* and the groove 71*c*, the grip 75 and the holder 71 are fixed with each other.

On supplying ink to the resin member 81, the grip 75 can be easily separated from the holder 71 by disengaging the projection 75*b* and the engaging groove 71*c*. Further, the cap 79 can be easily detached from the top of the support cylinder 71*b*. Ink is supplied to the resin member 81 through a channel formed in the support cylinder 71*b*.

An Outline of a Stamp Making Device

Figure 2:
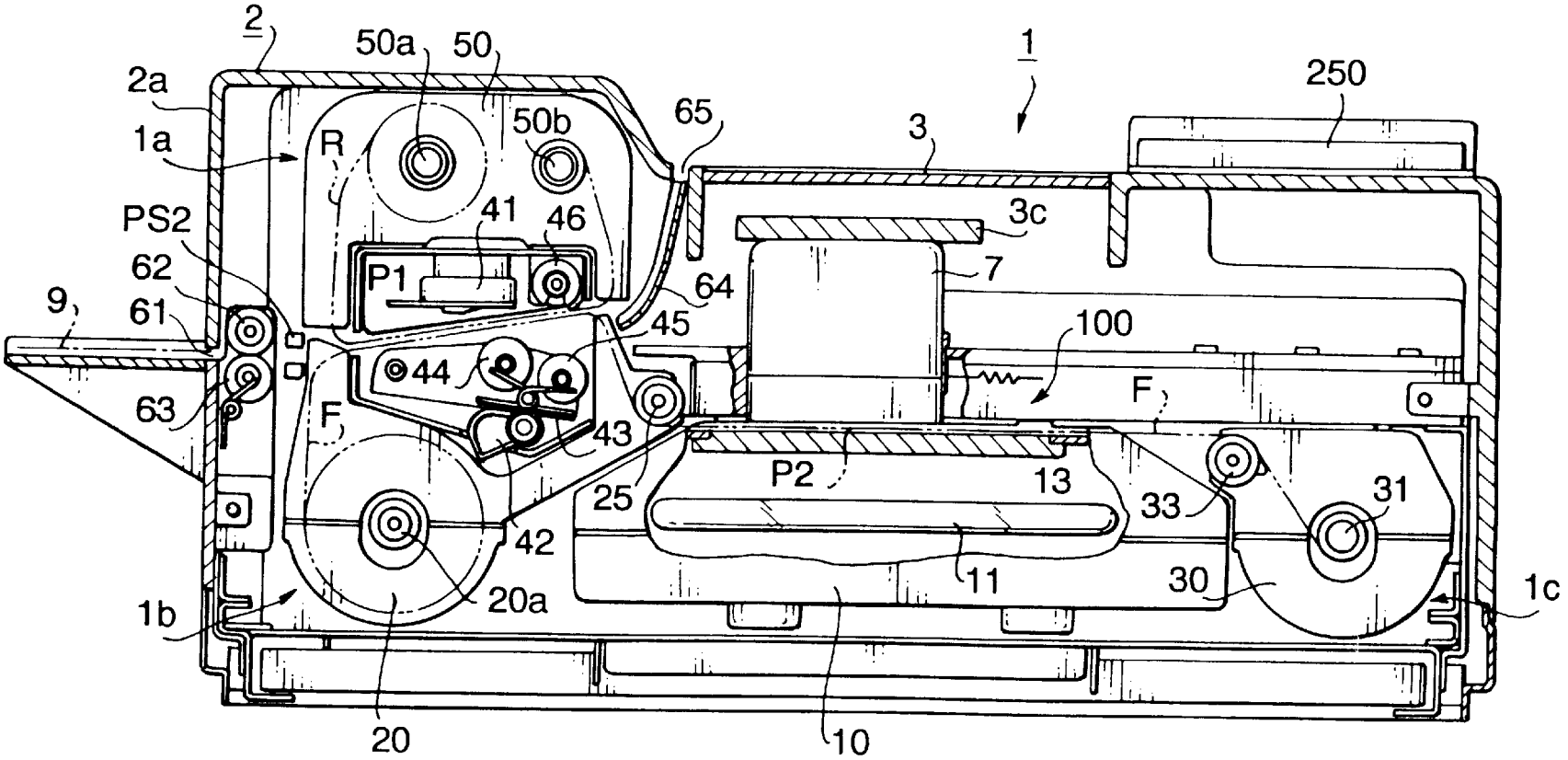
FIG. 2 is a longitudinal sectional view of a stamp making device according to the first embodiment.
Figure 3:
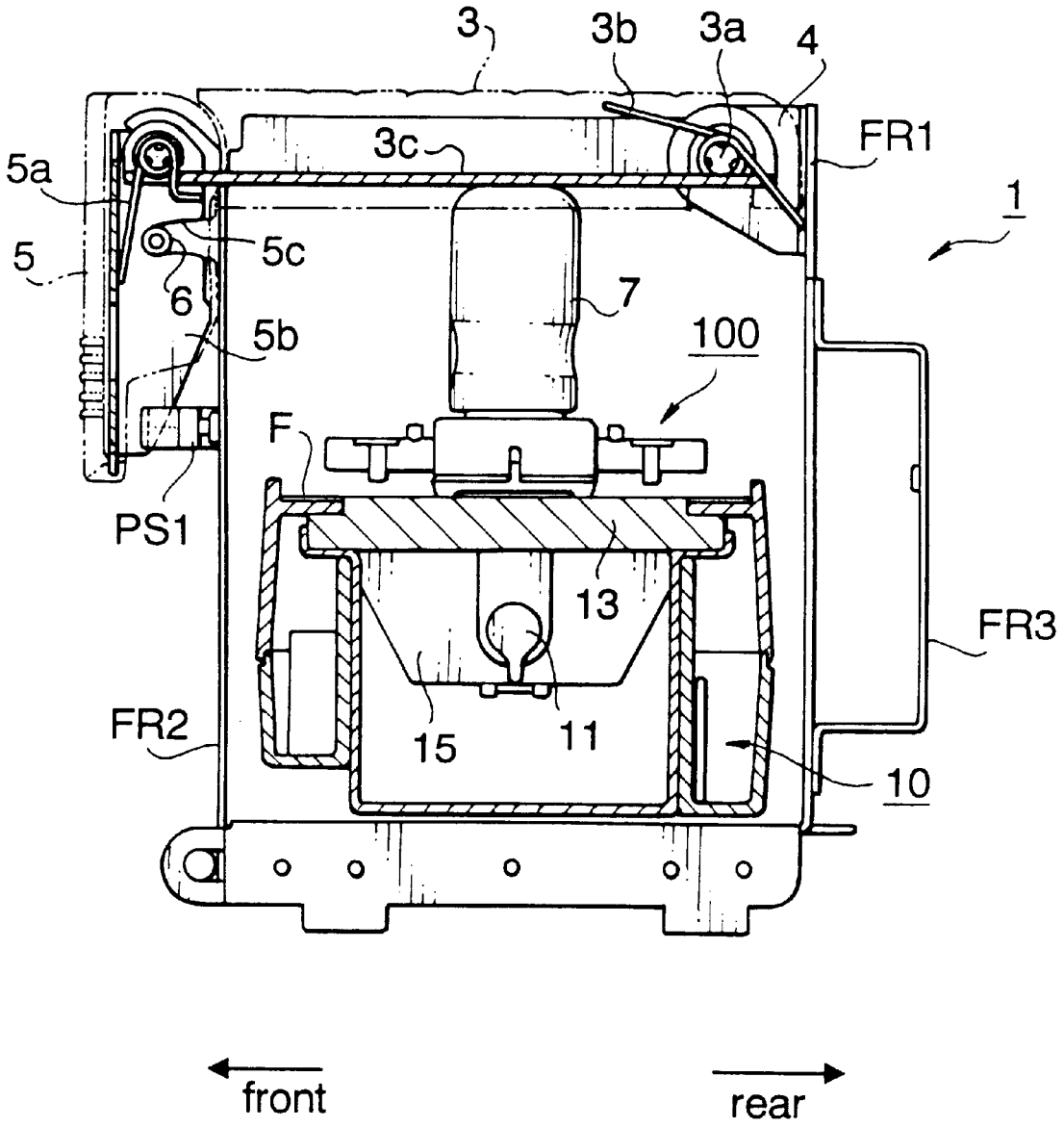
FIGS. 3 and 4 are traverse sectional views of the stamp making device with lids thereof being closed and opened.
Figure 4:
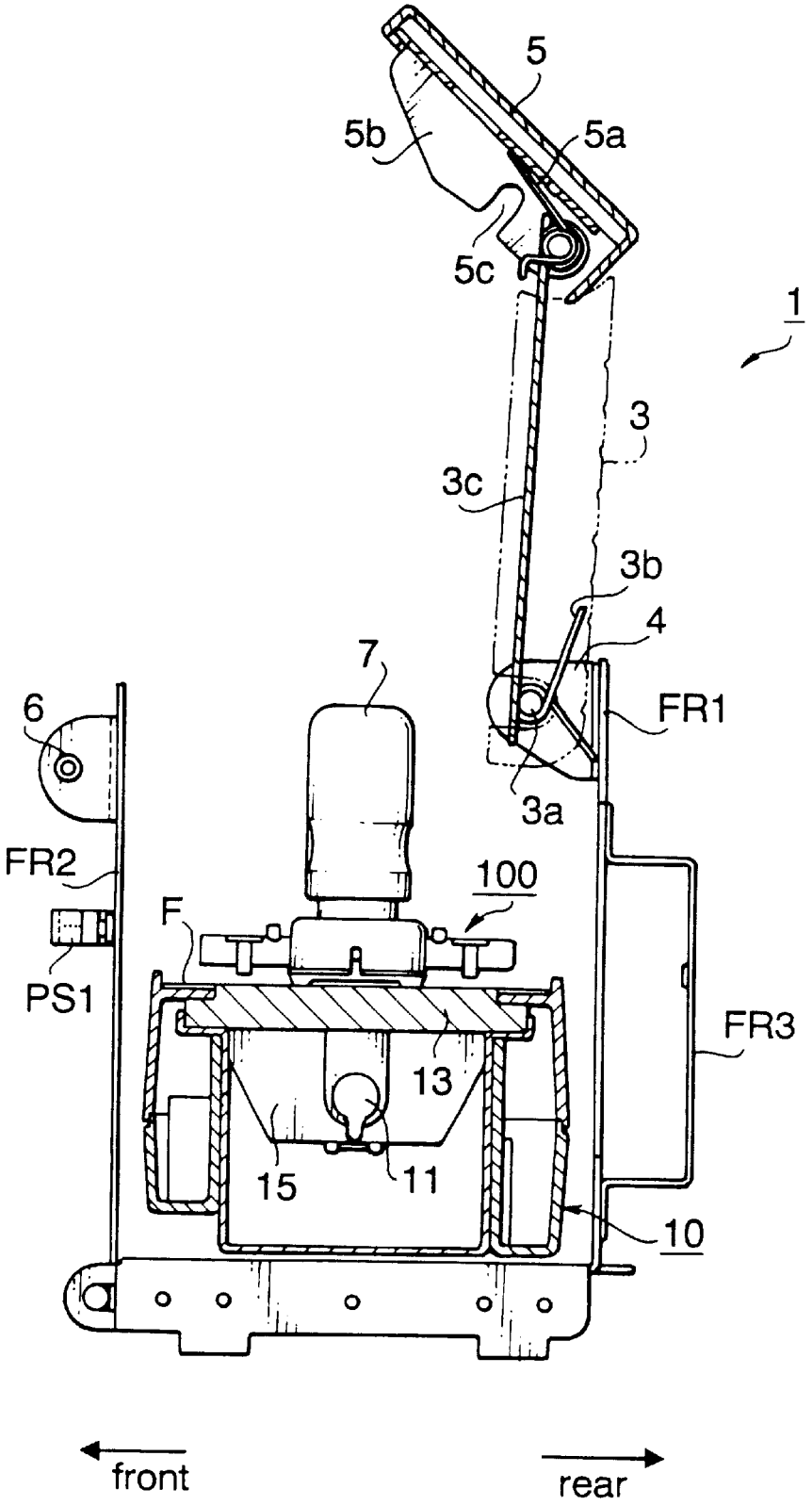

A stamp making device 1 is described. FIG. 2 is a longitudinal sectional view of the stamp making device 1. FIGS. 3 and 4 are traverse sectional views of the stamp making device 1. The stamp making device 1 has a rectangular body 2. An irradiation unit 10 is located at the center of the body 2. As shown in FIG. 3, the irradiation unit 10 includes a xenon tube 11, a reflector box 15 surrounding the xenon tube 11 and a transparent support plate 13 (made of acryl plastic) provided above the xenon tube 11. The stamp 7 is placed on the transparent support plate 13 of the irradiation unit 10 so that the resin member 81 (FIG. 1A) is faced with the transparent support plate 13, with an original film F intervened between the resin member 81 and the transparent support plate 13. When the light (from the xenon tube 11) irradiates the resin member 81 via an original film F, a stamp pattern is formed on the resin member 81 as detailed later.

Original Printing Unit

An arrangement for making the original film F is described. The original film F is made of a transparent film. An image is printed on the original film F by means of a thermal head 41. As shown in FIG. 2, a film supply cassette 20 is provided at one side (the left side in FIG. 2) of the body 2. The film supply cassette 20 has a film supporting roller 20*a* on which the original film F is wounded. A film winding cassette 30 is provided at the other side (the right side in FIG. 2) of the body 2. The film winding cassette 30 has a film winding roller 31 which winds the original film F thereon. When the film winding roller 31 is rotated, the original film F supported on the film supporting roller 20*a* is fed to the film winding roller 31, proceeding through the irradiation unit 10.

A ribbon cassette 50 is mounted above the film supply cassette 20. The ribbon cassette 50 includes a ribbon supporting roller 50*a* and a ribbon winding roller 50*b*. An ink ribbon R supported on the ribbon supporting roller 50*a* is fed to the ribbon winding roller 50*b*.

Figure 5:
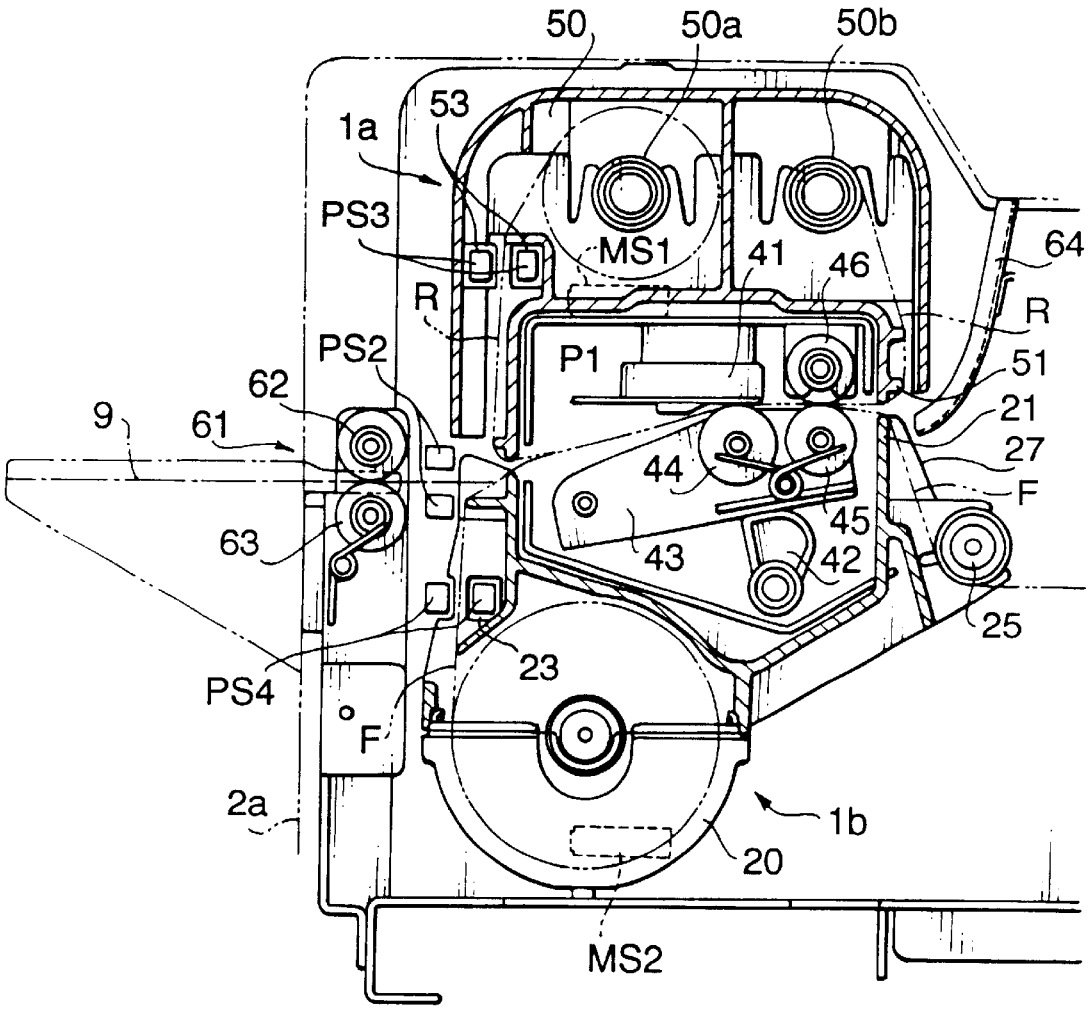
FIG. 5 is an enlarged view of an original printing unit of the stamp making device of FIG. 2.

FIG. 5 is an enlarged view of the left part of the stamp making device 1. The thermal head 41 is located between the ribbon cassette 50 and the film supply cassette 20, so that the thermal head 41 is faced with the ink ribbon R fed from the ribbon supporting roller 50*a* to the ribbon winding roller 50*b*. A feeding roller 46 is provided at a downstream side (right side) of the thermal head 41. A platen 44 and a pinch roller 45 are provided beneath the thermal head 41 and the feeding roller 46, respectively. The platen 44 and the pinch roller 45 are supported on a swingable arm 43 which is swung by a cam 42 toward and away from the thermal head 41. When the swingable arm 43 is swung toward the thermal head 41 as shown in FIG. 5, the ink ribbon R and the original film F are laminated and nipped by the thermal head 41 and the platen 44 (and nipped by the feeding roller 46 and the pinch roller 45).

Figure 16:
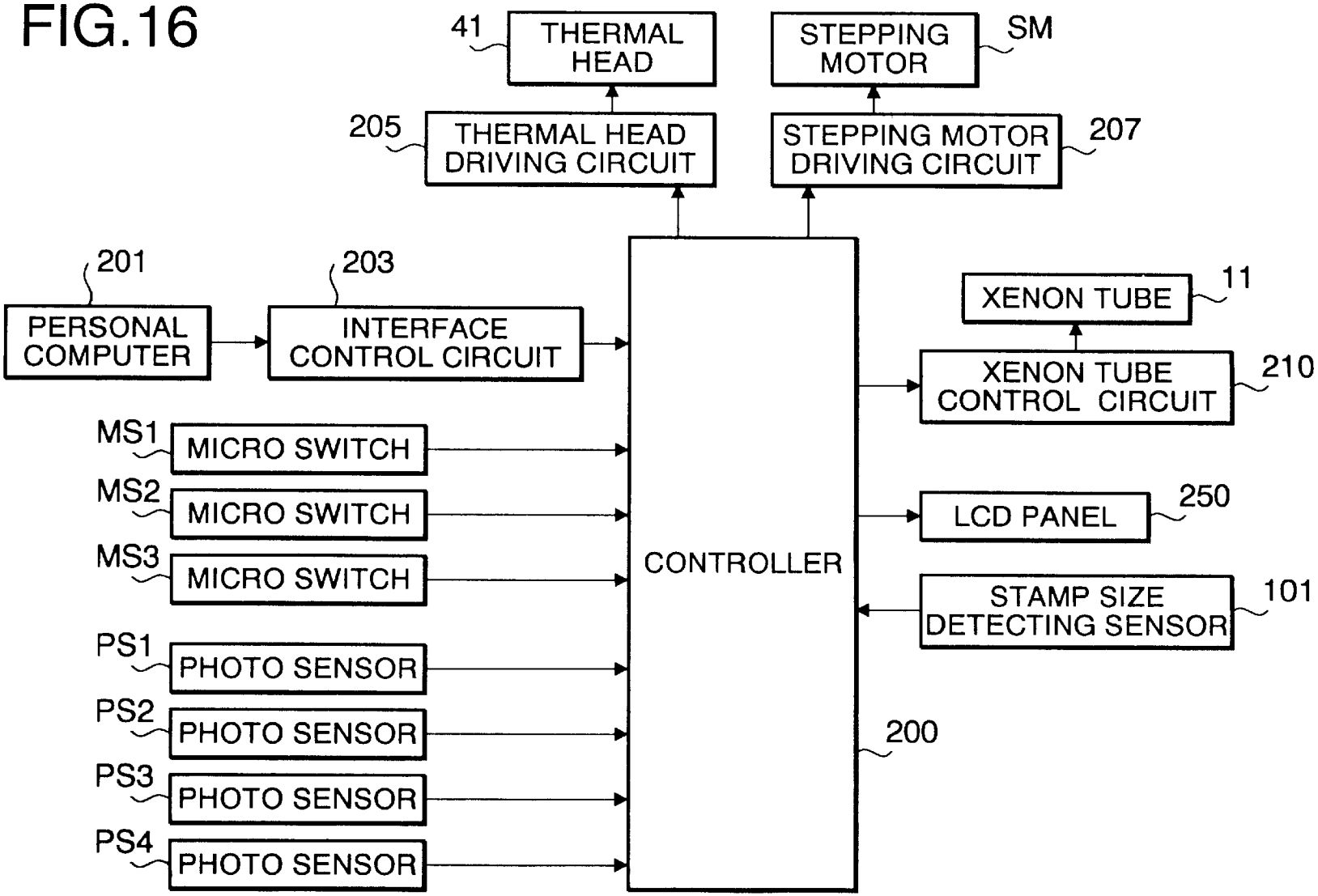
FIG. 16 is a block diagram showing a control system of the stamp making device.

A controller 200 (FIG. 16) of the stamp making device 1 drives the thermal head 41 and intermittently rotates the feeding roller 46, according to image information sent from a personal computer 201 (FIG. 16). A heated portion of the ink ribbon R is melted and transferred onto the original film F. Since ink of the ink ribbon R does not allow the light (from the xenon tube 11) to transmit, a printed image on the original film F does not allow the light to transmit.

In order to separate the ink ribbon R and the original film F, change-direction-frames 21 and 51 are formed on the cassettes 20 and 50, both of which are located downstream side of the feeding roller 46. The ink ribbon R turns upward at the change-direction-frame 51, while the original film F turns downward at the change-direction-frame 21. That is, the original film F and ink ribbon R are separated just after the image is printed on the original film F. With such an arrangement, image blurring caused by the unintentional contact of the original film F and the ink ribbon R is prevented. After the separation, the ink ribbon R is wound on the ribbon winding roller 50*b* in the ribbon cassette 50. The original film F is led to a change-direction-roller 25 provided to the upstream side of the irradiation unit 10.

Irradiation Unit

As shown in FIG. 3, a stamp mounting unit 100 is provided above the irradiation unit 10. The stamp 7 is mounted to the stamp mounting unit 100 so that the resin member 81 (FIG. 1A) is placed on the transparent support plate 13 of the irradiation unit 10. With this, the resin member 81 is faced with the xenon tube 11 via the transparent support plate 13.

The stamp making device 1 has a top lid 3 swingably provided at the top of the body 2. The top lid 3 has a pivoting shaft 3*a* which is supported by a bracket 4 provided to a rear frame FR1 of the body 2. A front lid 5 is swingably provided to the front end of the top lid 3.

A torsion spring 3*b* is provided to the pivoting shaft 3*a*, which biases the top lid 3 so that the top lid 3 is erected as shown in FIG. 4. Further, the front lid 5 is biased by a torsion spring 5*a* so that the tip of the front lid 5 is lifted up as shown in FIG. 4. Accordingly, when the lids 3 and 5 are opened, the top of the stamp making device 1 widely opens. With this, a user is able to access a stamp mounting unit 100 (located above the irradiation unit 10) without being interfered by the lids 3 and 5.

When the lids 3 and 5 are closed, a hole 5*c* formed on a lib 5*b* of the front lid 5 engages an engaging pin 6 provided to a front frame FR2 of the body 2. With this, the lids 3 and 5 are locked as shown in FIG. 3. In order to detect if the lids 3 and 5 are closed, a photo sensor PS1 is provided to the front frame FR2 of the body 2. When the lids 3 and 5 are closed, the lib 5*b* is inserted into a gap between a light-emitting element and a light-receiving element of the photo sensor PS1.

The top lid 3 has a biasing plate 3*c*. When the top lid 3 is closed as shown in FIG. 3, the biasing plate 3*c* biases the stamp 7 downward, so that the resin member 81 of the stamp 7 is urged onto the transparent support plate 13. There is a possibility that the stamp 7 is inclined when the biasing plate 3*c* abuts against the stamp 7. However, due to the curvature of the top surface of the grip 75 of the stamp 7 (FIG. 1A), the stamp 7 recovers its original attitude by itself.

An irradiation process is briefly described. A user opens the top and front lids 3 and 5 as shown in FIG. 4. Then, the user mounts the stamp 7 on the stamp mounting unit 100. In this state, the stamp 7 is placed on the transparent support plate 13. After mounting the stamp 7, the user closes the top and front lids 3 and 5 as shown in FIG. 3. Since the biasing plate 3*c* of the top lid 3 biases the stamp 7 downward, the resin member 81 of the stamp 7 is urged against the transparent support plate 13, with the original film F intervened therebetween. In particular, the biasing force of the biasing plate 3*c* is so set that the thickness of the second layer 81*b* of the resin member 81 decreases by 1 to 2 mm.

Then, a lower surface of the resin member 81 is irradiated with the light from the xenon tube 11 via the original film F. The light incident on the transparent portion of the original film F passes through the original F and reaches the resin member 81. Conversely, the light incident on the ink pattern on the original film F is blocked. The light-energy-absorbing material in the resin member 81 absorbs the light (for example, infrared rays). Thus, the irradiated portions of the resin member 81 are heated. The heated portions of the resin member 81 are melted and solidified, while the non-heated portions of the resin member 81 remain unchanged.

After the irradiation of the resin member F is completed, the user opens the lids 3 and 5. With this, the biasing force of the biasing plate 3*c* disappears. In this state, since the non-irradiated portions of the resin member 81 have elasticity, the non-irradiated portions of the resin member 81 recover their original thickness. On the other hand, since the irradiated portions of the resin member 81 are solidified, the thickness of the irradiated portions of the resin member 81 remain the same as they are biased. Accordingly, the non-irradiated portions of the resin member 81 become projections. Further, pores of the non-irradiated portions of the resin member 81 remain open, while pores of the irradiated portions of the resin member 81 are closed. Thus, stamp ink impregnated in the resin member 81 is transmitted through the non-irradiated portions of the resin member 81 to a recording media. As described above, a stamp pattern is formed on the resin member 81.

An Arrangement for Making a Label

Figure 6A:
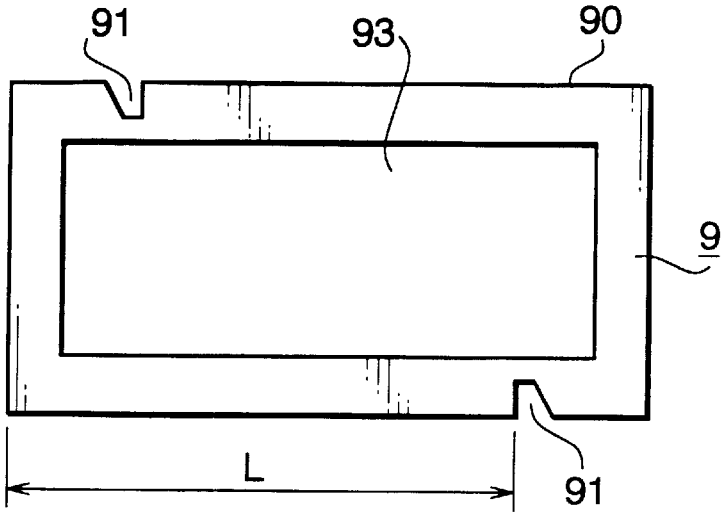
FIGS. 6A and 6B are schematic views showing dimensions used for making a label.

A label is attached to the outer surface of the stamp 7 so that a user can easily recognize a pattern of the stamp 7. The label is made of a cut sheet 9 shown in FIG. 6A. The cut sheet 9 is made of an adhesive seal having a separable sheet. The print portion 93 can be separated from the other part of the cut sheet 9, so that the print portion 93 can be attached to the top of the stamp 7. The cut sheet 9 has two notches 91 at both longitudinal edges of the cut sheet 9. The notches 91 are located at symmetrical positions with respect to a center point of the cut sheet 9. Each of the notches 91 is apart from respective ends of the cut sheet 9 by a distance L.

As shown in FIG. 2, a cut sheet inlet 61 is provided to a left side wall 2*a* of the stamp making device 1 for inserting a cut sheet 9 therein. A pair of introducing rollers 62 and 63 are provided at the cut sheet inlet 61. The cut sheet 9 is fed by the introducing rollers 62 and 63 to a printing position P1, where the cut sheet 9, the ink ribbon R and the original film F are nipped by the thermal head 41 and the platen 44.

A photo sensor PS2 is provided in the downstream side of the introducing rollers 62 and 63. The photo sensor PS2 is located at a left side portion of the feeding direction of the cut sheet 9. The photo sensor PS2 includes a light-emitting element and a light-receiving element. The above-described length L is determined so that the rear left notch 91 reaches the photo sensor PS2 when the front end of the cut sheet 9 is nipped by the rollers 46 and 45 (FIG. 7B) When the front end of the cut sheet 9 reaches the photo sensor PS2, the photo sensor PS2 turns off. Then, when the rear left notch 91 reaches the photo sensor PS2, the photo sensor PS2 turns on. With this, it is possible to detect if the front end of the cut sheet 9 is nipped by the feeding roller 46 and the pinch roller 45 (that is, the cut sheet 9 reaches the printing position P1). Then, the controller 200 (FIG. 16) drives the thermal head 41 and the feeding roller 46, thereby to heat the ink ribbon R according to the inputted image. Heated portions of the ink ribbon R are melted and transferred to the cut sheet 9, which makes the label.

Since the cut sheet 9 has two notches 91 located at symmetrical positions with respect to the center point, the orientation of the cut sheet 9 (being fed to the printing position P1) can be opposite. Thus, if the size of the image to be printed on the cut sheet 9 is sufficiently small, it is possible to feed the cut sheet 9 to the printing position P1 twice by changing the orientation of the cut sheet 9, and to perform the printing on the cut sheet 9 twice.

Figure 7:
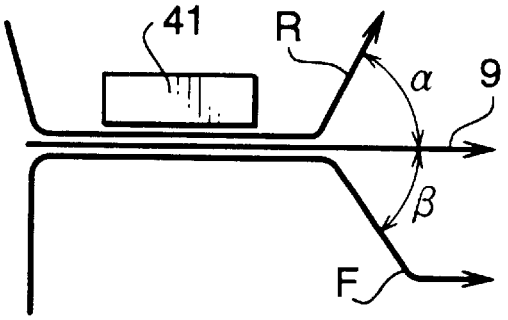
FIG. 7 is a schematic view showing a separation of a cut sheet, an original film and an ink ribbon.

After the image is printed on the cut sheet 9, the ink ribbon R and the original film F are respectively led upward and downward at the change-direction frames 51 and 21. The cut sheet 9 is guided diagonally up to the right by a guiding plate 64 and discharged through an outlet opening 65 provided at the top of the stamp making device 1. In particular, the separating angle a of the ink ribbon R and the cut sheet 9 is larger than 45 degrees as shown in FIG. 7. Also, the separating angle β of the cut sheet 9 and the original film F is larger than 45 degrees. Since the cut sheet 9 is relatively hard, the cut sheet 9 does not easily bent more than 45 degree. With this, the cut sheet 9 and the original film F and the ink ribbon R are well separated, even when the cut sheet 9 is attached to the original film F due to the electrostatics.

Sensors Provided in the Original Printing Unit

As shown in FIG. 5, a micro-switch MS1 is provided to a ribbon cassette mounting portion 1*a*, which detects if the ribbon cassette 50 is mounted. Further, a micro-switch MS2 is provided to a film support cassette mounting portion 1*b*, which detects if the film support cassette 20 is mounted. Based on the outputs from the micro-switches MS1 and MS2, the controller 200 (FIG. 16) recognizes if the ribbon cassette 50 and the film support cassette 20 are mounted to the stamp making device 1.

Further, in order to detect tail ends of the ink ribbon R and the original film F, photo sensors PS3 and PS4 are provided to the ribbon cassette mounting portion 1*a* and the film support cassette mounting portion 1*b*. The photo sensor PS3 projects to the interior of the ribbon cassette 50 through an opening 53 of the cassette 50. The photo sensor PS3 includes a light-emitting element and a light-receiving element located on both sides of a path of the ink ribbon R. The tail end of the ink ribbon R is transparent, while the other portion of the ribbon R is not transparent. Thus, when the tail end of the ink ribbon R reaches the photo sensor PS3, the photo sensor PS3 turns on. On the other hand, the photo sensor PS4 projects to the interior of the film support cassette 20 through an opening 23 of the cassette 20. The photo sensor PS4 includes a light-emitting element and a light-receiving element located on both sides of a path of the original film F. The tail end of the original film F is black, while the other portion of the original film F is transparent. Thus, when the tail end of the original film F reaches the photo sensor PS4, the photo sensor PS4 turns off. Based on the outputs from the photo sensors PS3 and PS4, the controller 200 (FIG. 16) recognizes if the cassettes 20 and 50 have run out of the ink ribbon R and the original film F.

A Guiding Structure of the Original Film

Figure 8:
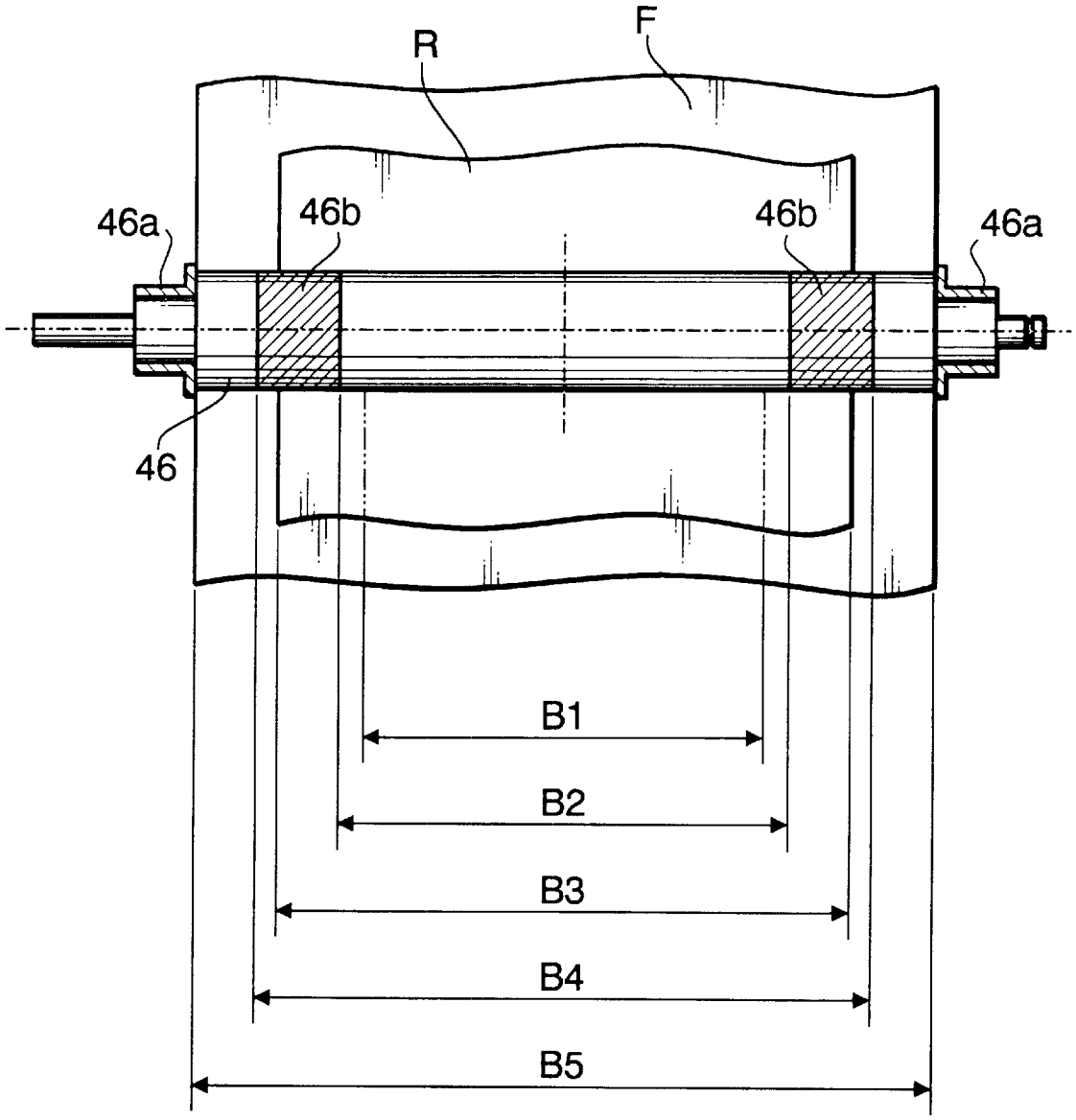
FIG. 8 is a schematic view showing dimensions of a feeding roller of the stamp making device of FIG. 2.

A guiding structure of the original film F is described. FIG. 8 is a plan view of the feeding roller 46. The feeding roller 46 has two guide bush 46*a* (each having flange) at both longitudinal ends thereof. The distance between the flanges of the guide bushes 46*a* corresponds to the width of the original film F. With this, both lateral ends of the original film F are guided by the flanges of the guide bushes 46.

Further, the feeding roller 46 has two embossed surfaces 46*b* formed at longitudinal end portions thereof. The width of the original film F is larger than the distance B4 between the outer ends of the embossed surfaces 46*b*. The distance B4 between the outer ends of the embossed surfaces 46*b* is larger than the width B3 of the ink ribbon R. Further, the width B3 of the ink ribbon R is larger than the distance B2 between the inner ends of the embossed surfaces 46*b*. With this, the projections of the embossed surfaces 46*b* grip both of the ink ribbon R and the original film F. Thus, the slippage of the ink ribbon R and the original film F is prevented.

Further, since the width B1 of the printing area of the original film F is smaller than the distance between the inner ends of the embossed surfaces 46*b*, the projections of the embossed surfaces 46*b* do not interfere with the printing area of the original film F. Thus, the printed image on the original film F is not damaged nor burred.

Figure 9:
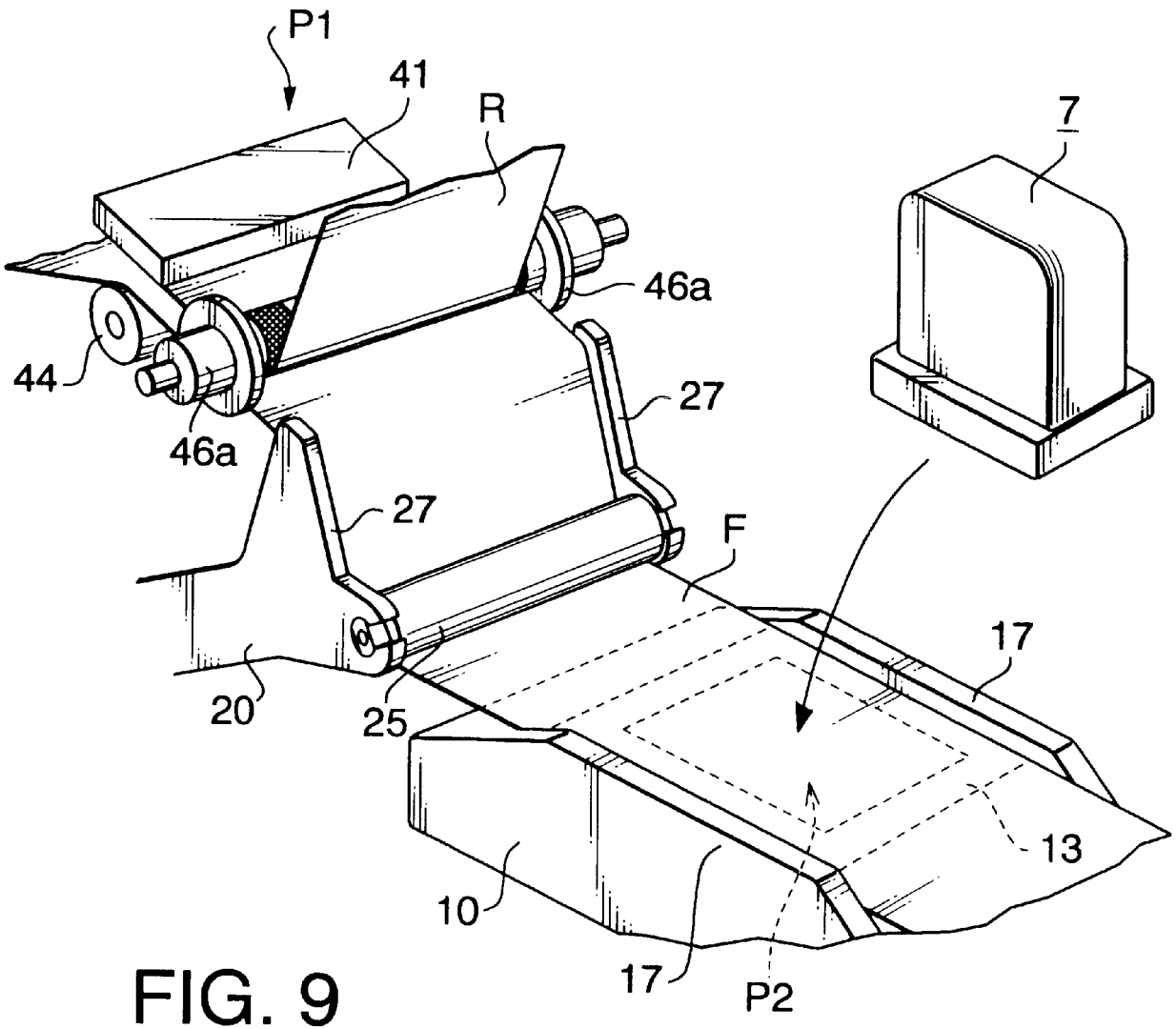
FIG. 9 is a perspective view of a guiding structure of a film of the stamp making device of FIG. 2.

FIG. 9 is a perspective view of the guiding structure of the original film F. A change-direction-roller 25 is provided to the film support cassette 20, which is located beneath the change-direction-frame 21 (FIG. 5) and on a upstream side of the irradiation unit 10. Two guide frames 27 are provided to the film support cassette 20 to guide both lateral sides of the original film F between the change-direction-frame 21 (FIG. 5) and the change-direction-roller 25. Further, the irradiation unit 10 has two guide frames 17 which guide both lateral sides of the original film F on the transparent support plate 13. The guide bushes 46*a* of the feeding roller 46, the guide frames 27 of the film support cassette 20, and the guide frames 17 of the irradiation unit 10 constitute a guiding structure of the original film F. With this, the original film F is fed from the printing position P1 to the transparent support plate 13 without a positioning error. Thus, the relative position of the image on the original film F with respect to the resin member 81 (FIG. 1A) of the stamp 7 is correctly set.

Cassettes Mounting Structure

Figure 10A:
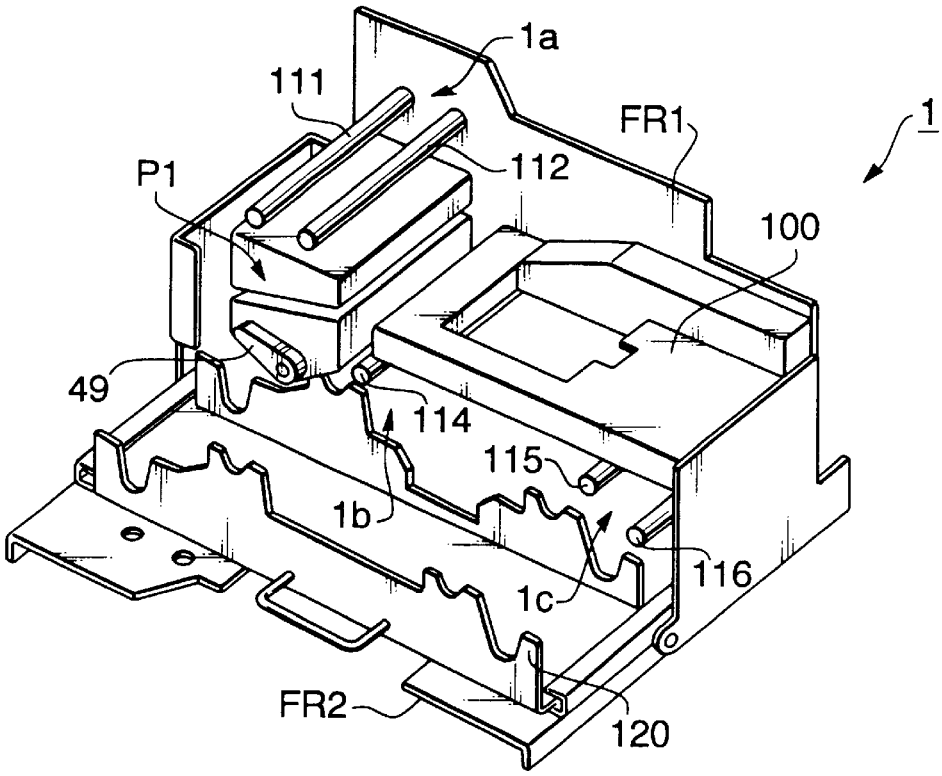
FIGS. 10A and 10B are perspective views of a mounting arrangement for cassettes.
Figure 10B:
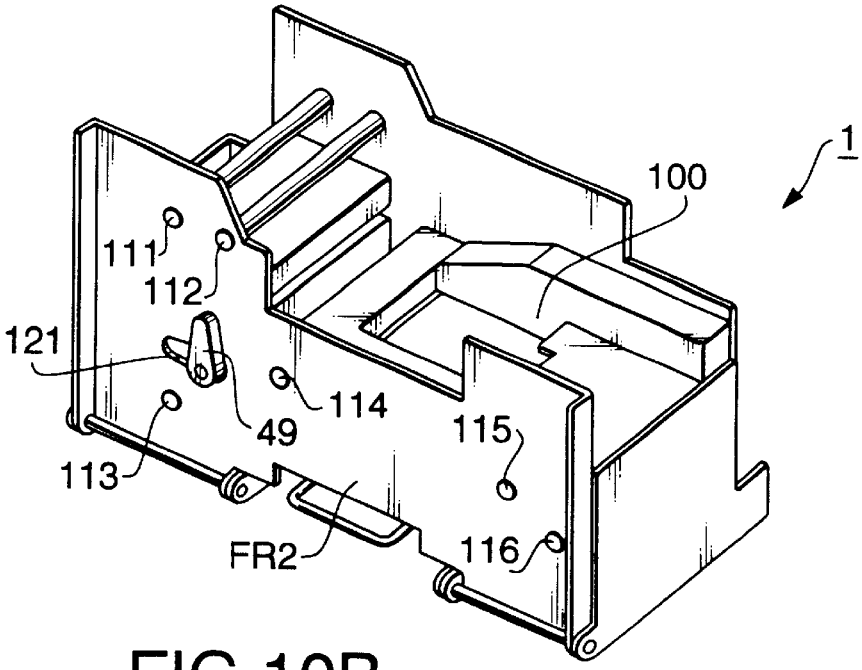

FIGS. 10A and 10B are perspective views showing the internal structure of the stamp making device 1. As shown in FIGS. 10A and 10B, the front frame FR2 is swingable with respect to the body 2 of the stamp making device 1. In the ribbon cassette mounting portion 1*a*, laterally extending shafts 111 and 112 are planted on the rear frame FR1. When the ribbon cassette 50 (FIG. 5) is mounted to the ribbon cassette mounting portion 1*a*, the shafts 111 and 112 are respectively inserted into the ribbon supporting roller 50*a* and the ribbon winding roller 50*b* (FIG. 5). With this, the ribbon supporting roller 50*a* and the ribbon winding roller 50*b* are rotatably supported by the shafts 111 and 112.

In the film support cassette mounting portion 1*b*, laterally extending shafts 113 and 114 are planted on the rear frame FR1. When the film support cassette 20 (FIG. 5) is mounted to the film support cassette mounting portion 1*b*, the shafts 113 and 114 are respectively inserted into the film supporting roller 20*a* and the change-direction-roller 25 (FIG. 2). With this, the film supporting roller 20*a* and the change-direction-roller 25 are rotatably supported by the shafts 113 and 114.

In a film winding cassette mounting portion 1*c*, laterally extending shafts 115 and 116 are planted on the rear frame FR1. When a film winding cassette 30 is mounted to the stamp making device 1, the shafts 115 and 116 are inserted into the film winding roller 31 (FIG. 2) and a change-direction-roller 33 (FIG. 2) provided to the upstream side of the film winding roller 31. With this, the film winding roller 31 and the a change-direction-roller 33 are rotatably supported by the shafts 115 and 116. As constructed above, the respective cassettes 50, 20 and 30 can be easily mounted to and detached from the stamp making device 1.

Further, when the front frame FR2 is closed as shown in FIG. 10B, the shafts 111, 112, 113, 114, 115 and 116 are supported by the rear and front frames FR1 and FR2. Thus, the respective cassettes 50, 20 and 30 are securely supported.

A drawer plate 120 is provided to the body 2. While the front frame FR2 is opened, the drawer plate 120 can be slid frontward as shown in FIG. 10A. The film support cassette 20, the irradiation unit 10 and the film winding cassette 30 are placed on the drawer plate 120. Thus, by pushing the drawer plate 120 into the stamp making device 1, the film support cassette 20, the ink irradiation unit 10 and the film winding cassette 30 are mounted to the stamp making device 1. In order to detect if the irradiation unit 10 is mounted, not-shown connectors are provided to the rear frame FR1 and the irradiation unit 10. The connectors are arranged to couple with each other when the irradiation unit 10 is mounted to the stamp making device 1.

In order to move the platen 44 and the pinch roller 45 (FIG. 5), a lever 49 is provided to the front frame FR2. The lever 49 and the cam 42 are rotatable about a common axis along with each other. When the lever 49 is erected as shown in FIG. 10B, the platen 44 abuts against the thermal head 41.

When the lever 49 lies as shown in FIG. 10A, the platen 44 moves apart from the thermal head 41. The front frame FR2 has an opening 121 through which the lever 49 passes., The opening 121 is so shaped that the lever 49 can pass through only when the lever 49 lies as shown in FIG. 10A. That is, the ribbon cassette 50 can not be detached when the platen 44 abuts against the thermal head 41. Thus, it is prevented that a user mistakenly detach the ribbon cassette 50 while the ink ribbon R is nipped by the platen 44 and the thermal head 41. Accordingly, the damage of the ink ribbon R and the original film F (caused by mistaken operation) can be prevented.

Figure 11:
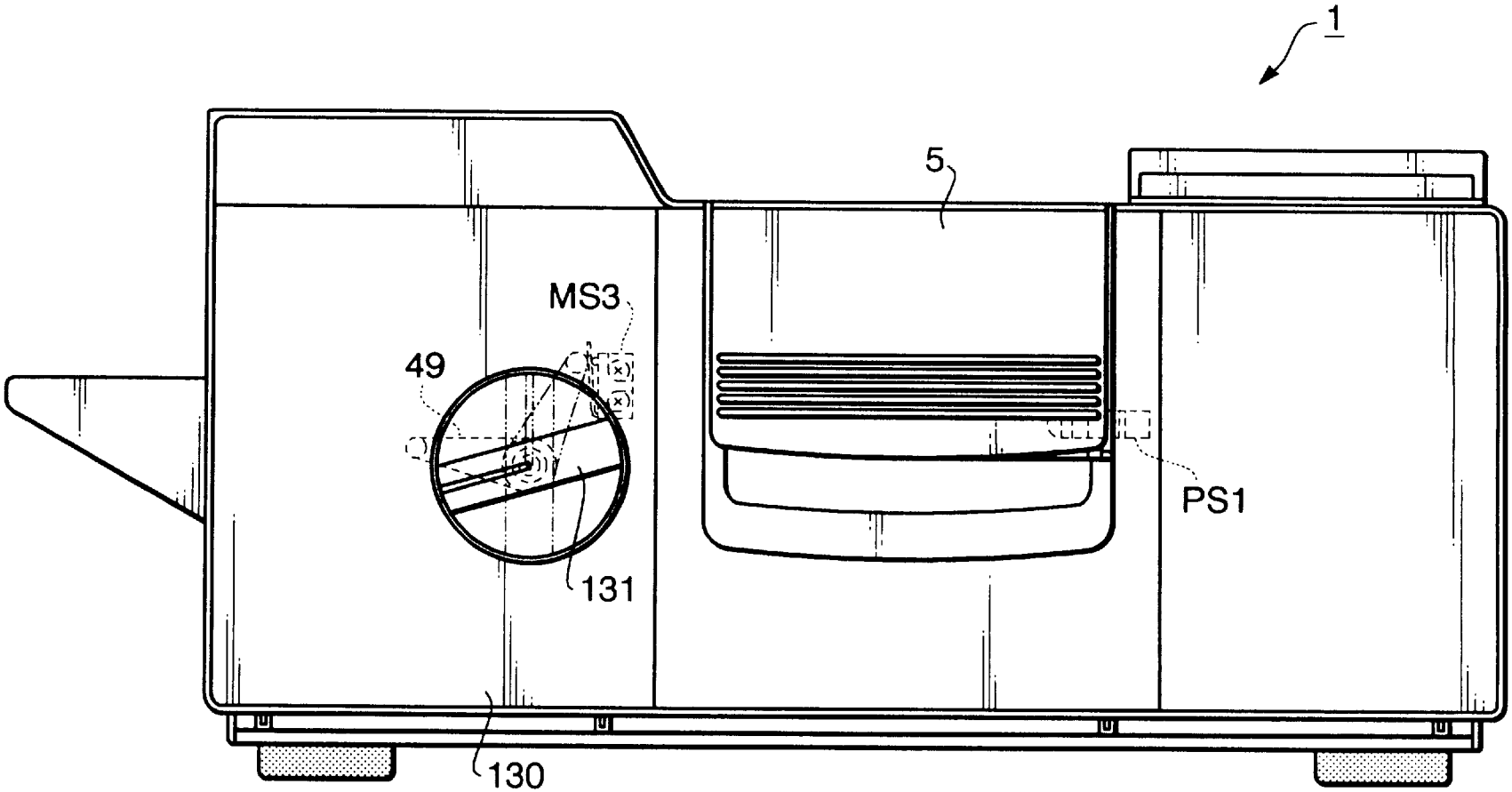
FIG. 11 is a front view of the stamp making device of FIG. 2.

FIG. 11 is a front view of the stamp making device 1. A front panel 130 is provided to the front side of the front frame FR2. The lever 49 is connected to a knob 131 provided to the front panel 130, so that the lever 49 is rotated when a user turns the knob 131. In order to detect if the lever 49 erects, a micro-switch MS3 is provided to the rear side of the front panel 130.

Feeding Mechanism

Figure 12:
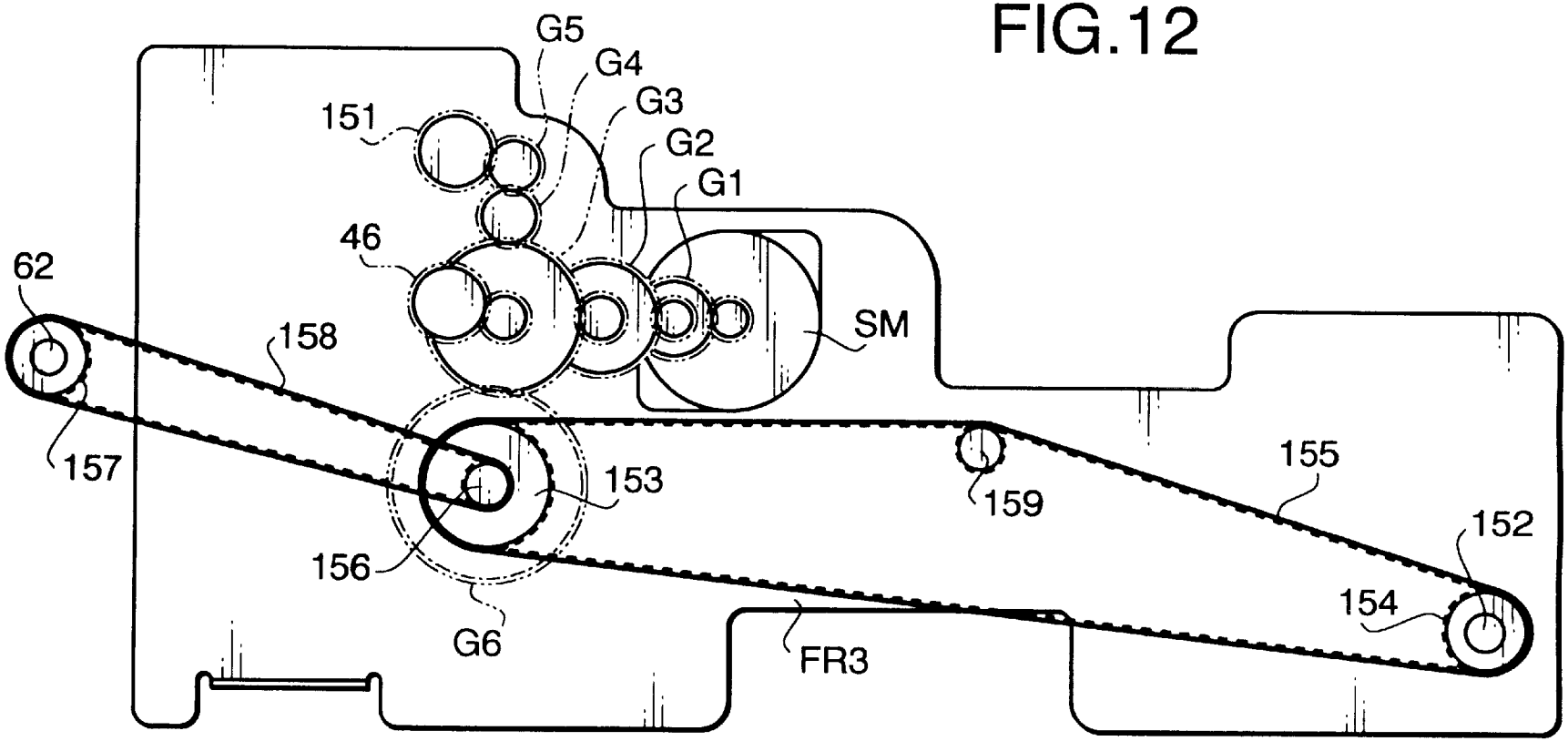
FIG. 12 is a front view of a feeding mechanism of the stamp making device of FIG. 2.

A feeding mechanism of the ink ribbon R, the original film F and the cut sheet 9 is described. The feeding mechanism is supported on a mounting frame FR3 provided to the rear side of the rear frame FR1. FIG. 12 shows the feeding mechanism, seen from the front side of the mounting frame FR3. The feeding mechanism includes a stepping motor SM, a first drive shaft 151 which rotates the ribbon winding roller 50*b* (FIG. 2), and a second drive shaft 152 which rotates the film winding roller 31 (FIG. 2).

The rotation of the stepping motor SM is transmitted to the first drive shaft 151 via gears G1, G2, G3, G4 and G5. Each of the gears G1, G2 and G3 includes coaxial two gears having different teeth numbers. The rotation of the stepping motor SM is transmitted to the feeding roller 46 via gears G1, G2 and G3. The first drive shaft 151 is provided with a one-way clutch, so that the first drive shaft 151 is able to slip in a reversed direction. The rotation speed of the first drive shaft 151 is twice the rotation speed of the feeding roller 46. With this, during the winding of the ink ribbon R, tension is applied to the ink ribbon R irrespective of a winding amount of the ink ribbon R wound on the ribbon winding roller 50*b* (FIG. 2).

In order to drive the second drive shaft 152, pulleys 153 and 154 and a gear G6 meshing with the gear G3 are provided. A timing belt 155 is provided around the pulleys 153 and 154. A tensioning pulley 159 is further provided for adjusting a tension applied to the timing belt 155. The pulley 153 and the gear G6 are fixed to the same rotation shaft. With this, the rotation of the stepping motor SM is transmitted to the second drive shaft 152. The second drive shaft 152 is provided with a one-way clutch, so that the second drive shaft 152 is able to slip in a reversed direction. The rotation speed of the second drive shaft 152 is twice the rotation speed of the feeding roller 46. With this, during the winding of the original film F, tension is applied to the original film F irrespective of a winding amount of the original film F wound on the film winding roller 31 (FIG. 2).

A driven pulley 157 is fixed to a shaft of the introducing roller 62. A timing belt 158 is provided around the driven pulley 157 and a small pulley 156 fixed to the rotation shaft of the gear G6. The rotation speed of the introducing roller 62 is set to 90% of the rotation speed of the feeding roller 46. That is, when the cut sheet 9 is fed to the print portion, tension is applied to the cut sheet 9 by the difference in the feeding speed of the introducing roller 62 and the feeding roller 46. Accordingly, the positioning error of the cut sheet 9 can be prevented, so that the positioning error of the printed image on the cut sheet 9 is prevented. The introducing roller 62 is also provided with a one-way clutch.

Stamp Mounting Unit

Figure 13:
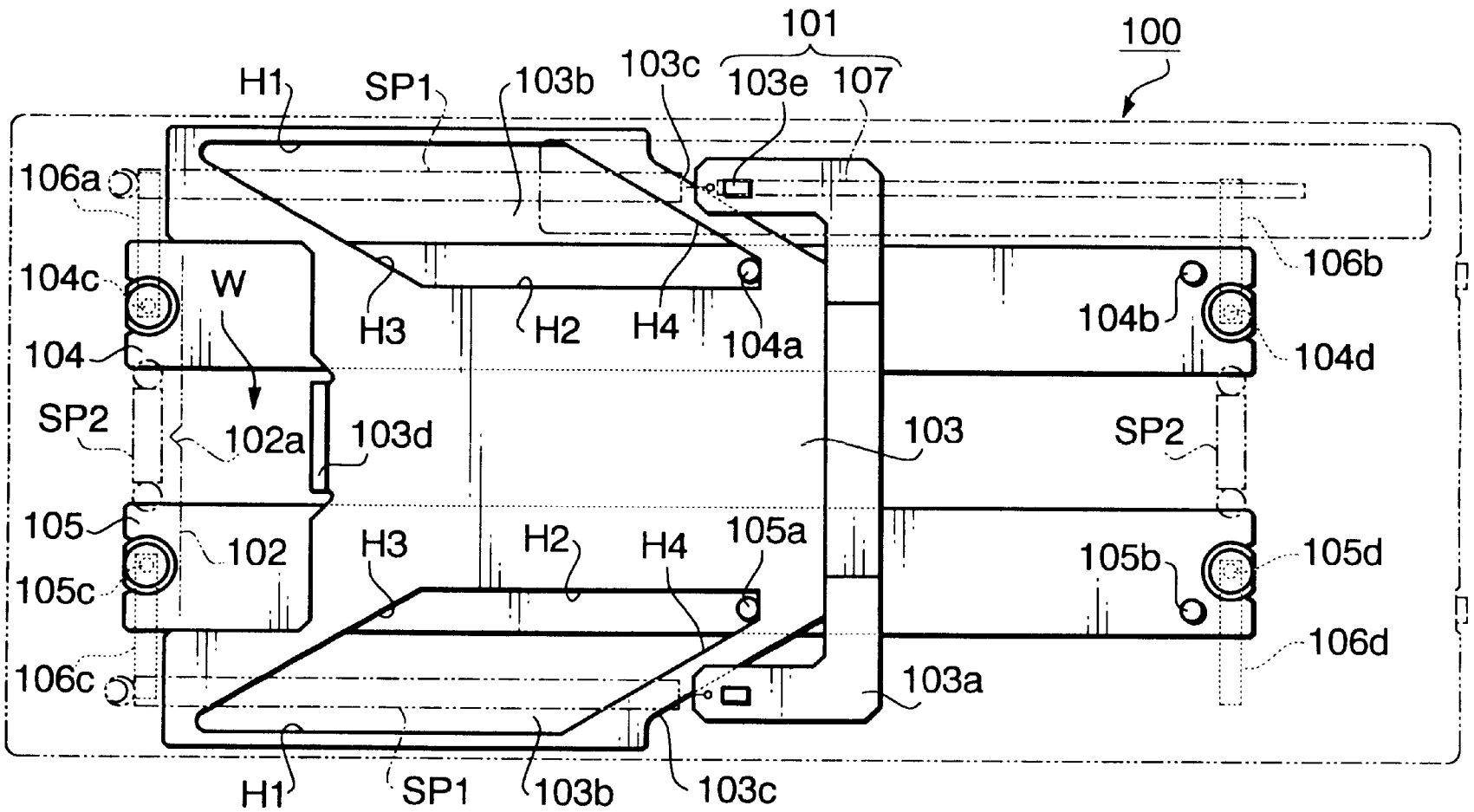
FIGS. 13 and 14 are plan views showing a stamp mounting unit.
Figure 14:
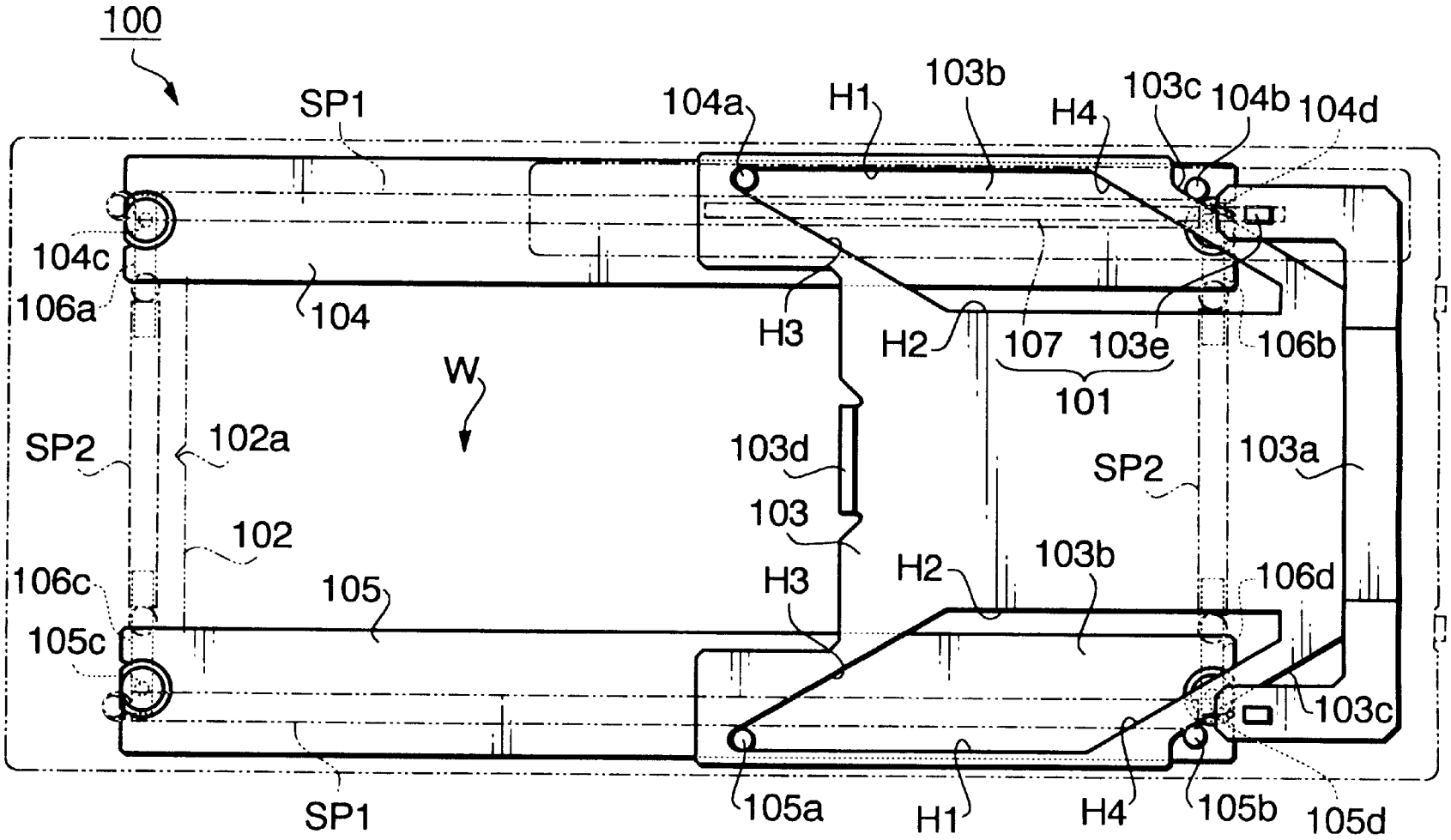
Figure 15:
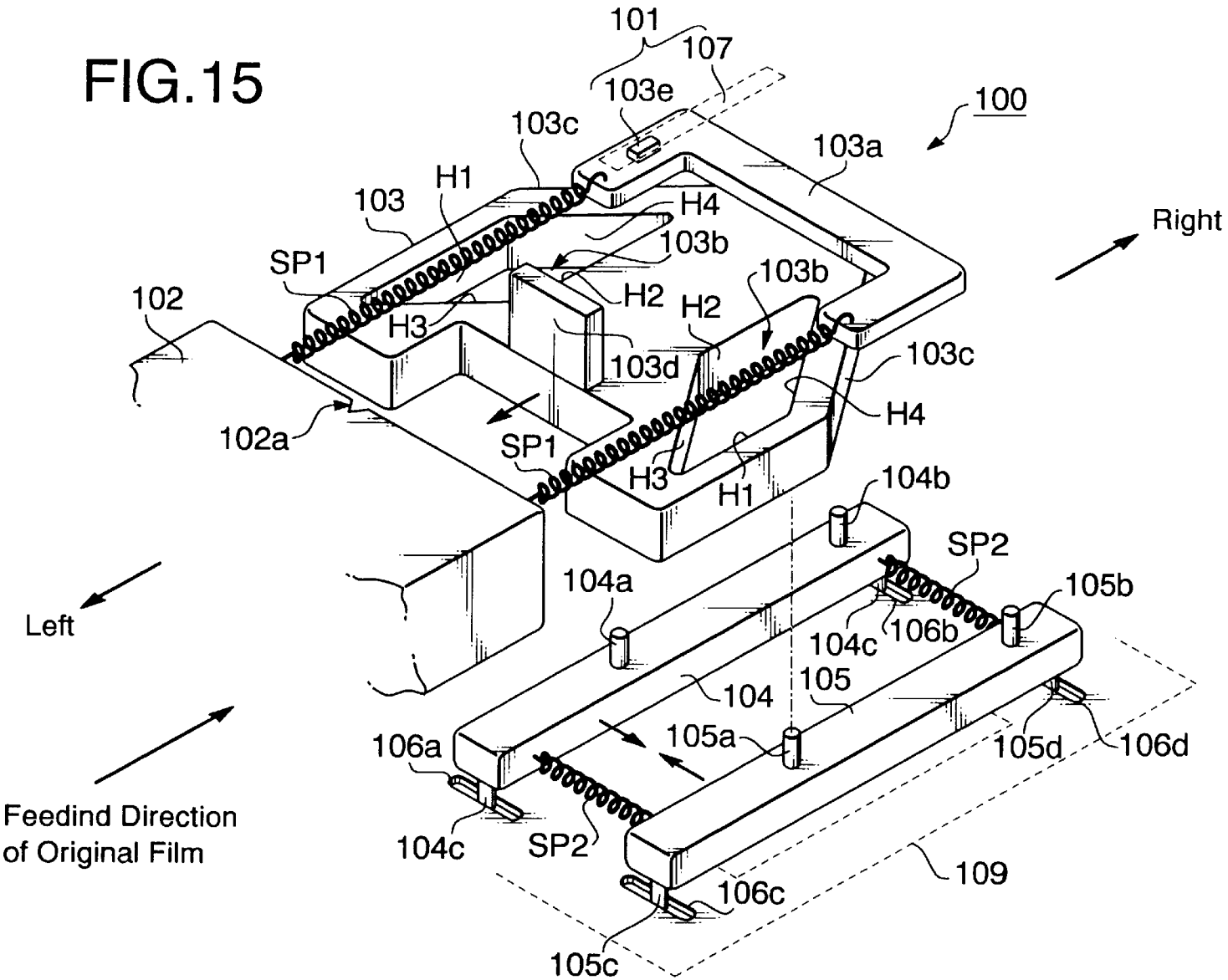
FIG. 15 is an exploded perspective view of the stamp mounting unit of FIG. 13.

FIGS. 13 and 14 are plan views of the stamp mounting unit 100. FIG. 15 is an exploded perspective view of the stamp mounting unit 100. As shown in FIG. 15, the stamp mounting unit 100 includes a stationary frame 102 and a slide block 103 arranged in the feeding direction of the original film F (that is, from left to right in FIG. 15). The slide block 103 is slidable toward and away from the fixed block 102. Further, the stamp mounting unit 100 includes front and rear blocks 105 and 104 which are slidable frontward and rearward (that is, in the width direction of the original film F). With this, the stamp mounting unit 100 is arranged to grip the stamp 7 with the stationary frame 102 and three blocks 103, 104 and 105.

The slide block 103 and the front and rear blocks 105 and 104 are supported on a support frame 109 shown by dash line in FIG. 15. In order to guide the front and rear blocks 105 and 104 in the width direction of the original film F, guide slits 106*a*, 106*b*, 106*c* and 106*d* are formed on the support frame 109. The front block 105 has two pins 105*c* and 105*d* respectively engaged in guide slits 106*c* and 106*d*. The rear block 104 has two pins 104*c* and 104*d* respectively engaged in guide slits 106*a* and 106*b*. Further, the front and rear blocks 105 and 104 are urged toward each other by coil springs SP2 provided therebetween.

The stationary frame 102 has a notch 102*a* which engages the positioning projection 73*d* (FIG. 1B) of the stamp 7. When the notch 102*a* engages the positioning projection 73*d* of the stamp 7, a center line of the stamp 7 is aligned with a center line of the original film F.

The slide block 103 has a frame 103*a*. Two springs SP1 are provided between the stationary frame 102 and the frame 103*a*, which urges the slide block 103 toward the stationary frame 102.

In order to move the front and rear blocks 105 and 104, the slide block 103 has two parallelogram openings 103*b*, which are symmetrical with each other with respect to the center line of the slide block 103. Each opening 103*b* has two edges H1 and H2 which are parallel to the film feeding direction and two inclined edges H3 and H4. The inner edges H2 of the openings 103*b* are shifted toward the right with respect to the outer edges H1 of the openings 103*b*. Further, the slide block 103 has inclined edges 103*c* at the right end thereof, which are parallel to the inclined edges H3 of the openings 103*b*. The front block 105 has two pins 105*a* and 105*b*, while the rear block 104 has two pins 104*a* and 104*b*. The pins 105*a* and 104*a* are located in the openings 103*b*. The pins 105*b* and 104*b* are located at the right side of the slide block 103.

In FIG. 13, a space W surrounded by the stationary frame 102 and three blocks 103, 104 and 105 is the smallest. When a user holds a knob 103*d* and move the slide block 103 away from the fixed block 102, the front and rear blocks 105 and 104 do not move until the pins 105*a* and 104*a* abut the inclined edges H3. When the pins 105*a* and 104*a* abut the inclined edges H3 (and when the pins 105*b* and 104*b* abut the inclined edges 103*c*), the front and rear blocks 105 and 104 are moved away form each other in synchronization with the movement of the slide block 103. When the space W is widen enough to mount the stamp 7 therein, the user mounts the stamp 7 in the space w in such a manner that the positioning projection 73*d* (FIG. 1B) of the stamp 7 engages the notch 102*a*. Then, the user moves the slide block 103 toward the fixed block 102. With this, the front and rear blocks 105 and 104 are moved toward each other by the spring force of the springs SP2. Thus, the stamp 7 is gripped by the stationary frame 102 and the blocks 103, 104 and 105.

In order to detect the position of the slide block 103, a contact 103*e* is provided on the frame 103*a* of the slide block 103. The contact 103*e* contacts a resistance 107 provided on a frame located above the slide block 103. The resistance 107 is elongated in the moving direction of the slide block 103. The contact 103*e* and the resistance 107 constitute a stamp size detecting sensor 101 for detecting the size of the stamp 7 based on the position of the slide block 103.

Control System

FIG. 16 is a block diagram showing the control system of the stamp making device 1. The stamp making device 1 is connected to an external personal computer 201. According to the information from the personal computer 201, the stamp making device 1 prints an image on the original film F or on the cut sheet 9, and transfers the printed image to the resin member 81 of the stamp 7.

The controller 200 of the stamp making device 1 is connected to an interface control circuit 203 which receives data from the personal computer 201, a thermal head driving circuit 205 which drives the thermal head 41, a stepping motor driving circuit 207 which drives the stepping motor SM, and a xenon tube control circuit 210 which controls the xenon tube 11. Further, the controller 200 is connected to the above-described photo-sensors PS1, PS2, PS3 and PS4, the micro-switches MS1, MS2 and MS3 and a liquid crystal display panel 250.

Further, the controller 200 is connected to the above-described stamp size detecting sensor 101 provided to the stamp mounting unit 100. The controller 200 recognizes the size of the stamp 7 based on the output from the stamp size detecting sensor 101 representing the longitudinal length of the stamp 7 gripped by the stamp mounting unit 100.

Operation of the Stamp Making Device

Figure 17:
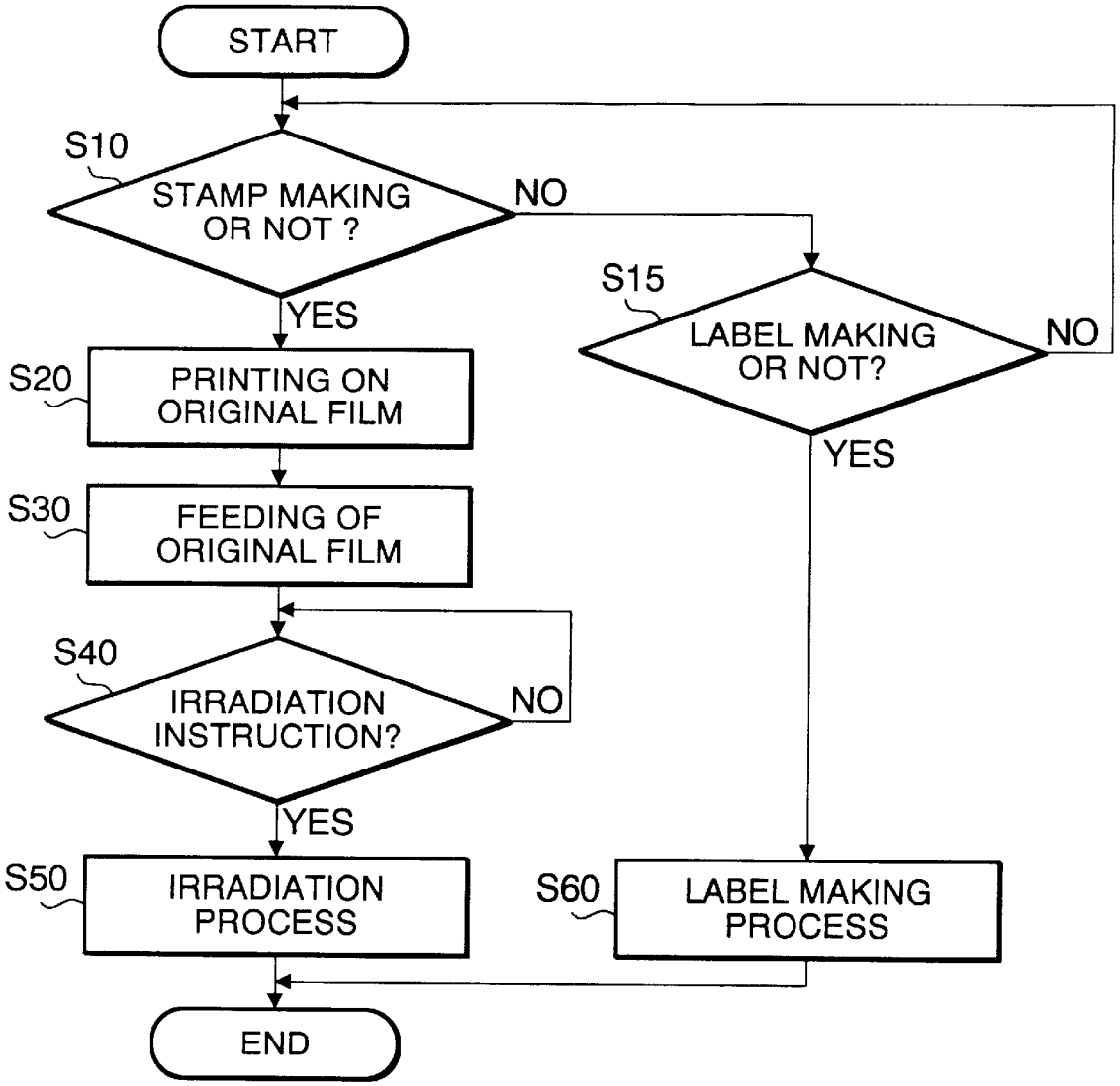
FIG. 17 is a flow chart showing a main flow of the stamp making device.

The operation of the stamp making device 1 is described. FIG. 17 is a flow chart showing the main flow of the operation of the stamp making device 1.

When the controller 200 receives an instruction signal from the personal computer 201, the controller 200 decides if the received instruction is an instruction of a stamp making (S10). If the stamp making process is selected (Yes in step S10), the controller 200 drives the stepping motor SM and the thermal head 41 thereby to print a positive image on the original film F (S20). Further, the controller 200 drives the stepping motor SM by a predetermined amount so that the original film F reaches an image transfer position P2 on the transparent support plate 13 (S30). Then, the controller 200 waits an instruction of the irradiation (S40). In this embodiment, when the top and front lids 3 and 5 are closed, the photo sensor PS1 outputs the instruction of irradiation. That is, when the user sets the stamp 7 on the stamp mounting unit 100 and closes the top and front lids 3 and 5, the irradiation process is performed (S50). In case of label making (No in step S10 and Yes in step S15), a label making process is performed (S60) instead of the operation of steps S20 through S50.

Figure 18:
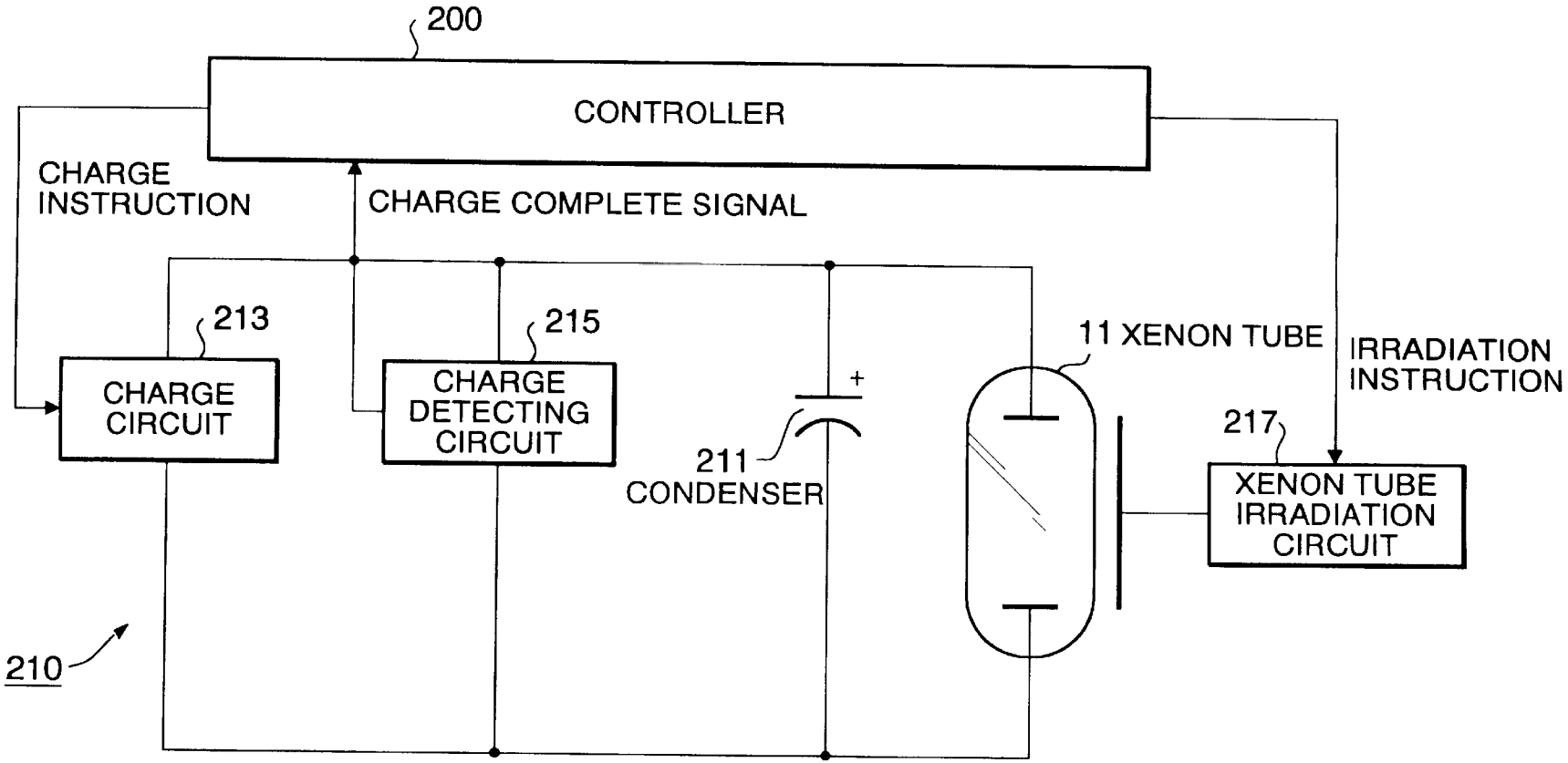
FIG. 18 is a block diagram showing an irradiation system of stamp making device.

The irradiation process is described with reference to FIGS. 18 and 19. FIG. 18 is a block diagram of the xenon tube control circuit 210. The xenon tube control circuit 210 includes a condenser 211 and a charging circuit 213 which charges the condenser 211. The xenon tube control circuit 210 further includes a charge detecting circuit 215 which detects a voltage charged in the condenser 211, and an irradiation circuit 217 which let the xenon tube 11 to emit the light.

Figure 19:
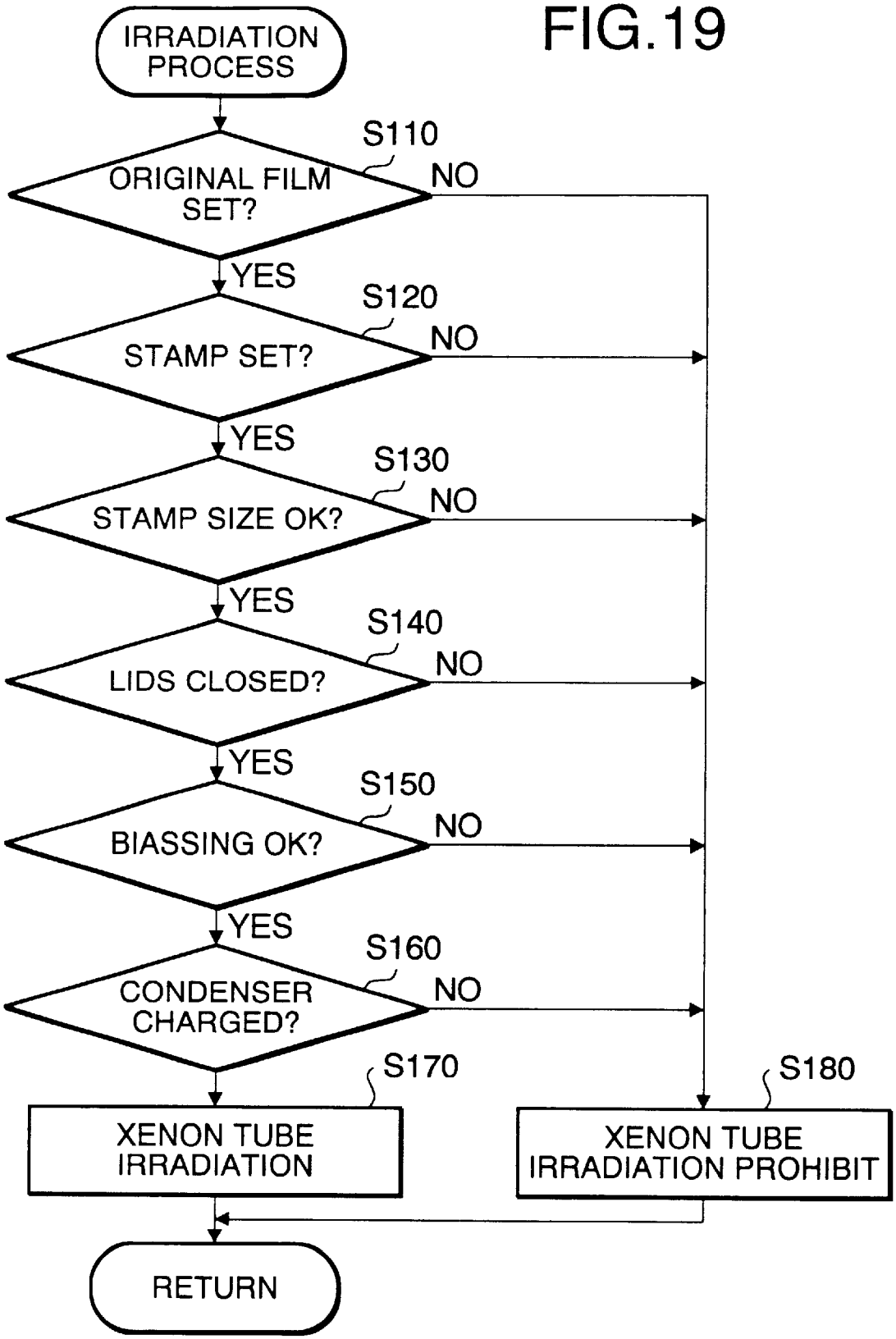
FIG. 19 is a flow chart of an irradiation process of the stamp making device.

The irradiation process is shown in FIG. 19. As shown in FIG. 19, the controller 200 detects if the printed image of the original film F is correctly positioned (S110), by checking if the previous operation and the previous feeding of the original film F have been correctly performed. Then, the controller 200 detects if the stamp 7 is mounted to the stamp mounting portion 100 (S120), by checking if an output voltage of the stamp size detection sensor 101 is larger than a predetermined value. Further, the controller 200 detects if the stamp size is correct (S130), by comparing the longitudinal length of the stamp 7 and the length of image data inputted from the personal computer 201.

Then, the controller detects if the top and front lids 3 and 5 are closed (S140), based on a detecting signal of the photo sensor PS1. Although the output signal photo sensor PS1 has already been checked in step S40 (FIG. 17), the controller 200 checks the photo sensor PS1 again. This is because there is a possibility that the previous output signal of the photo sensor PS1 is an error. Further, the controller 200 detects if the stamp 7 is correctly biased. This detection is performed by checking if a predetermined time has passed since the photo sensor PS1 detects the closing of the front and rear lids 3 and 5 (S150). Finally, the controller 200 detects if the xenon tube 11 is able to emit light (S160), based on an output voltage of the charge-voltage detecting circuit 215.

If all the checking results in the steps S110 through S160 are YES, the controller 200 drives the xenon tube irradiation circuit 217 so that the xenon tube 11 emits light (S170) If the checking results in the steps S110 through S160 includes No, the controller 200 prohibits the xenon tube 11 from emitting light (S180) and terminates the irradiation process.

As described above, due to the above-described checking process, a mistaken operation under insufficient condition is prevented. Thus, a generation of a waste printing plate is prevented.

Label Making Process

Figure 6B:
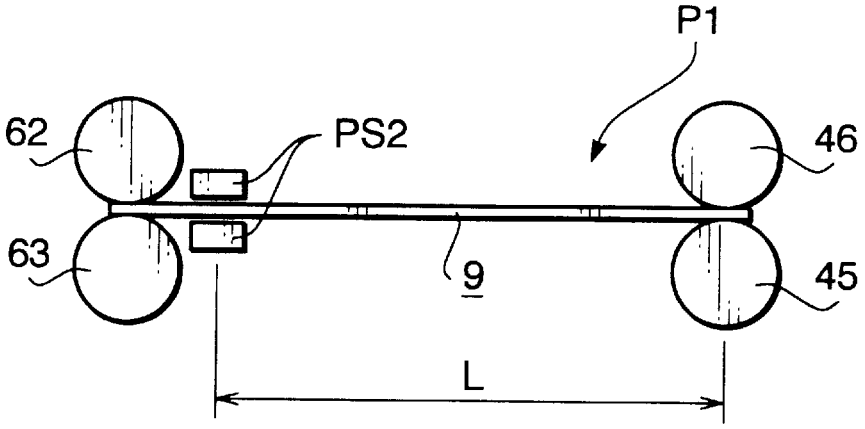
Figure 20:
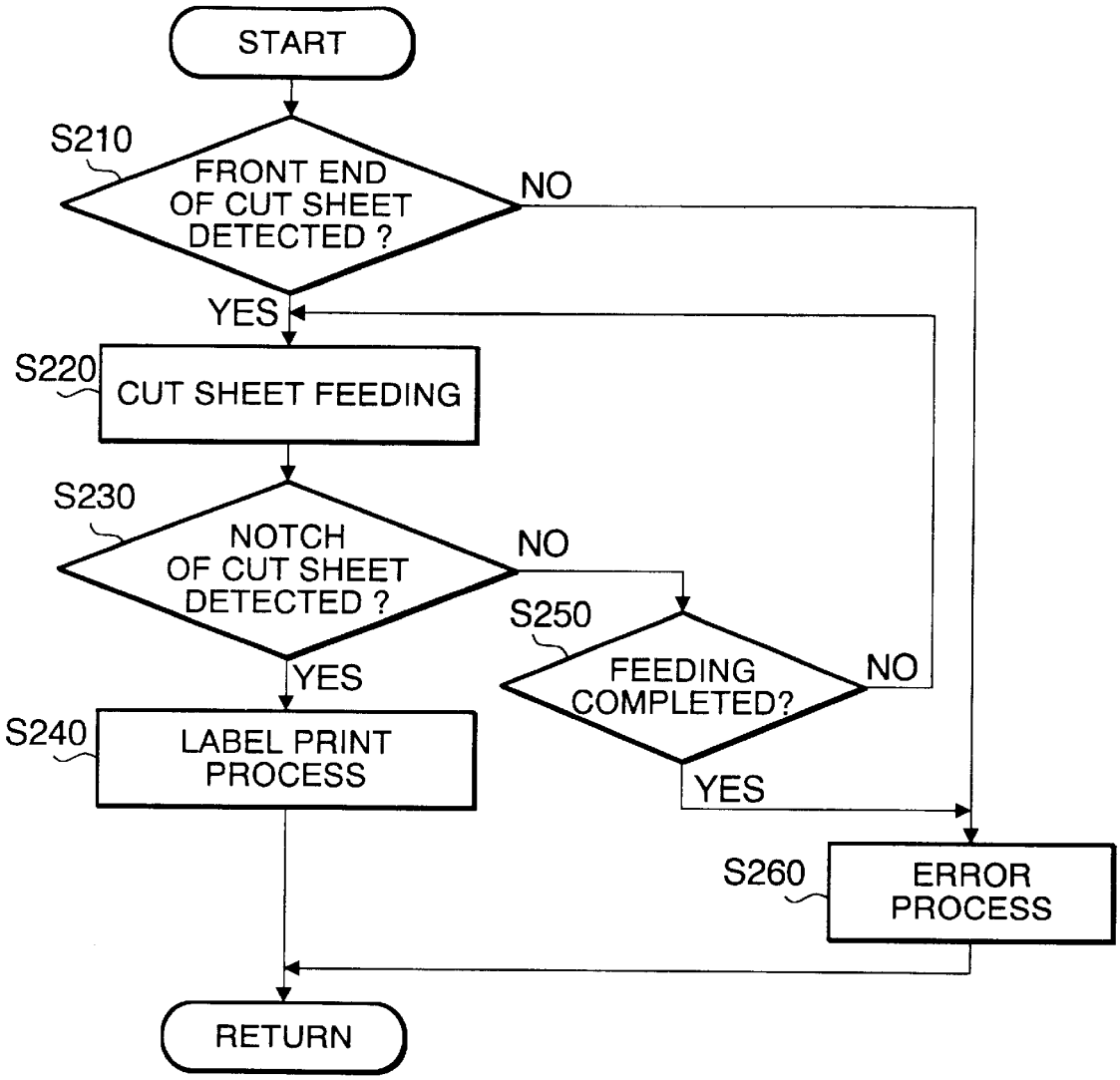
FIG. 20 is a flow chart of a label making process of the stamp making device.

As shown in FIG. 17, when the label making process is selected (No in S10), the label making process is started (S15). FIG. 20 shows the label making process. As shown in FIG. 20, the controller 200 checks if the photo sensor PS2 (FIG. 6B) detects the front end of the cut sheet 9 (S210). After the frond end of the cut sheet 9 is detected, the controller 200 continues to feed the cut sheet 9 until the notch 91 (FIG. 6B) thereof is detected by the photo sensor PS2 (S220 and S230). When the photo sensor PS2 detects the notch 91 (Yes in S230), it indicates that the cut sheet 9 is positioned in the printing position P1. Then, the controller 200 start the printing process on the cut sheet 9 (S240). That is, the controller 200 drives the stepping motor SM and the thermal head 41 thereby to print image on the cut sheet 9. With this, the label is formed. At the end of the printing process, the label is discharged through the outlet opening 65 (FIG. 2). If the photo sensor PS2 does not detect the front end of the cut sheet 9 in step S210, or if the photo sensor PS2 does not detect the notch 91 a predetermined time after the feeding of the cut sheet 9 is started (YES in S250), the error process is performed (S260). In this error process, the controller displays a message on the LCD panel 250, thereby to promote the user to insert the cut sheet 9 into the cut sheet inlet 61 (FIG. 2).

With such a process, the stamp making device 1 is able to make the label having the same pattern as the stamp 7.

As described above, according to the first embodiment, the stamp making device 1 is able to make a stamp pattern on the resin member 81 (the printing plate) without a washing process. Thus, the stamp making process becomes simple. Further, it is not necessary to store the resin member 81 in a light-shielded box. Further, since an image is printed on the original film F by means of the thermal head 41, it is possible to make any type of stamp pattern as long as it can be outputted to a printer. For example, it is possible to make a stamp pattern of characters or a picture image inputted via a digital camera.

Further, since the original film F is laid on the transparent support plate 13 so that a printed image of the original film F is faced with the resin member 81, the image on the original film F is so-called a 'positive' image. Thus, it is possible to print the image on the original film in a similar manner that a thermal printer prints an image on a paper. Due to the guiding structure of the original film F, the original film F is fed from the image printing position P1 to the image transfer portion P2 without positioning error. Thus, the original film can be correctly positioned on the irradiation unit 10.

According to the label making arrangement of the first embodiment, the stamp making device 1 is also able to make the label having the same pattern as the stamp 7. Further, since tension is applied on the cut sheet 9 when the cut sheet 9 is fed to the printing position, the positioning error of the cut sheet 9 can be prevented. Thus, the positioning error of the printed image on the cut sheet 9 is prevented.

According to the guiding structure of the original film F, the original film F is fed from the image printing position P1 to the image transfer portion P2 without positioning error. Thus, the original film F can be correctly positioned on the irradiation unit 10. Further, since the projections of the embossed surface 46*b* of the feeding roller 46 grip both of the original film F and the ink ribbon R, the blurring of the image due to the slippage of the original film F and the ink ribbon R is prevented. Thus, a clear image is obtained. Further, at the downstream side of the printing position P1, the original film F and the ink ribbon R are separated by the change-direction-frames 51 and 21. Accordingly, the original film F and the ink ribbon R are well separated.

According to the cassette mounting arrangement, the cassettes 10, 20 and 50 can be mounted to and detached from the stamp making device 1, by sliding the cassettes 10, 20 and 50 along the shafts 111 through 116. Thus, the replacement of the cassettes 10, 20 and 50 is easy to perform. Further, since the cassette replacement is enabled only when the thermal head 41 is apart from the platen 44, the erroneous detaching of the cassettes is prevented.

According to the checking processes prior to the irradiation of the xenon tube, the erroneous operation of the stamp making device 1 is prevented. Thus, a generation of a waste resin member 81 is prevented.

This checking processes can be employed in another type of stamp making device in which a porous resin member (which does not includes energy-absorbing-material) is urged onto a negative original film and is irradiated with light via the negative original film. The negative original film has a transparent image and a black background (including carbon) When the negative original film is irradiated with the light, the black background of the negative original film is heated, while the transparent image of the negative original film is not heated. Thus, portions of the resin member in contact with the black background are melted, so that pores included therein are sealed. Portions of the porous resin member in contact with the transparent image are not melted, so that pores included therein remain open. With this, a stamp pattern is formed on the resin member.

It is possible that the stamp making device 1 displays a message indicating the absence of the ribbon cassette 50 when the micro-switch MS1 detects the absence of the ribbon cassette 50 and a message indicating the absence of the film support cassette 20 when the micro-switch MS2 detects the absence of the film cassette 20. Further, it is possible that the stamp making device 1 displays a message indicating that the printing process is not possible, when the micro-switch MS3 detects the thermal head 41 being apart from the platen 45. Also, it is possible that the stamp making device 1 displays a message promoting the replacement of the ribbon cassette 50 when the photo sensor PS3 detects the end of the ink ribbon R and a message promoting the replacement of the film support cassette 20 when the photo sensor PS4 detects the end of the original film F.

Although the structure and operation of the stamp making device is described herein with respect to the first embodiment, many modifications and changes can be made without departing from the spirit and scope of the invention. For example, it is possible to employ a cut film as the original film F, instead of roll-type film in the first embodiment. Further, the above described embodiment can be applied to a stamp making device which makes a white character on a colored background using a negative original.

Figure 21:
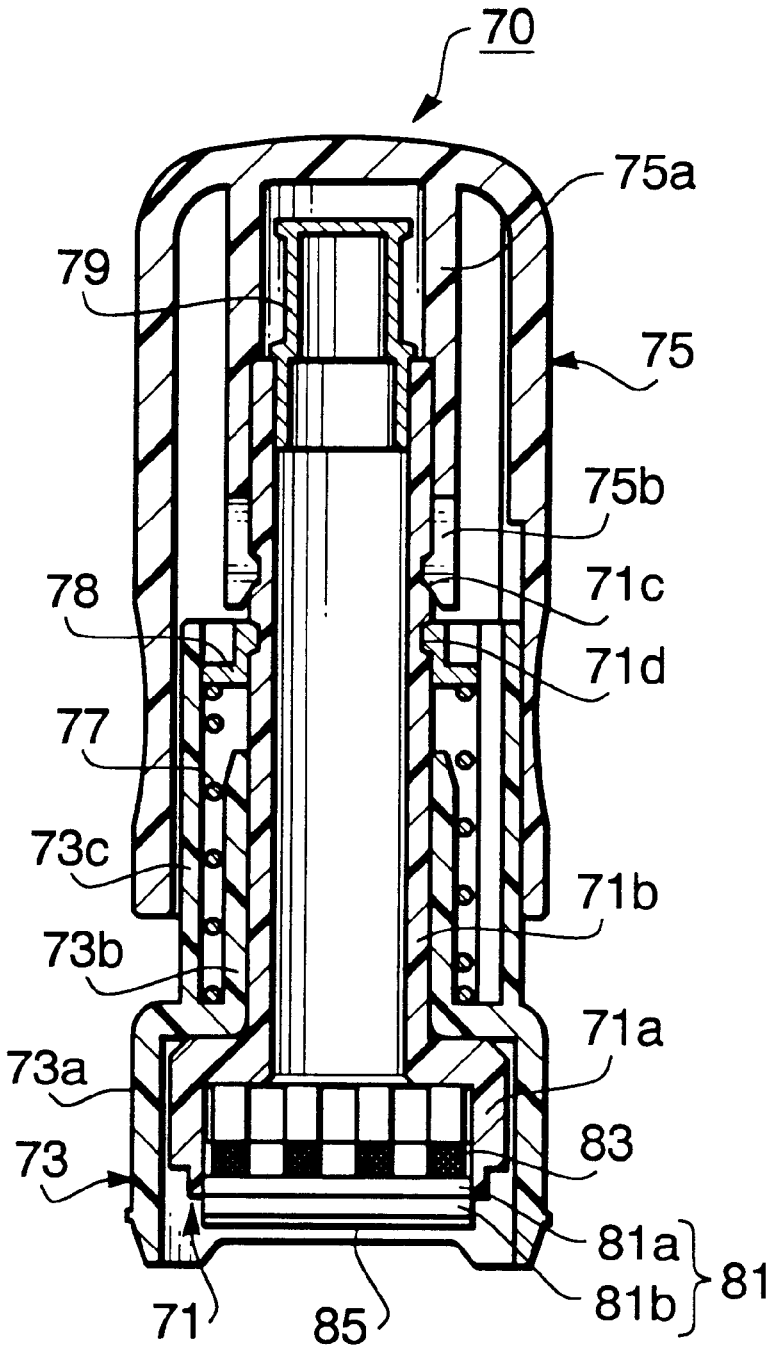
FIG. 21 is a sectional view showing a stamp of the second embodiment.

The second embodiment of the present invention is described. FIG. 21 shows a stamp 70 of the second embodiment. The stamp 70 of the second embodiment is the same as the stamp 7 of the first embodiment except that a protective film 85 is provided to the bottom of the resin member 81 of the stamp 70.

The protective film 85 is attached to the bottom surface of the lower layer 81*b* of the resin member 81. The protective film 85 is made of a transparent polyethylene terephthalate (PET) film whose thickness is from 0.025 to 0.2 mm. The stamp 70 is set to the stamp making device 1 (FIG. 3), so that the protective film 85 is placed on the original film F.

When the biasing plate 3*c* of the top lid 3 urges the stamp 7 downward, the resin member 81 is urged against the transparent support plate 13, with the original film F intervened therebetween. In this state, the protective film 85 is intervened between the original film F and the resin member 81. The biasing force of the biasing plate 3*c* is so set that the thickness of the lower layer 81b of the resin member 81 decreases by 1 to 2 mm.

Figure 22:
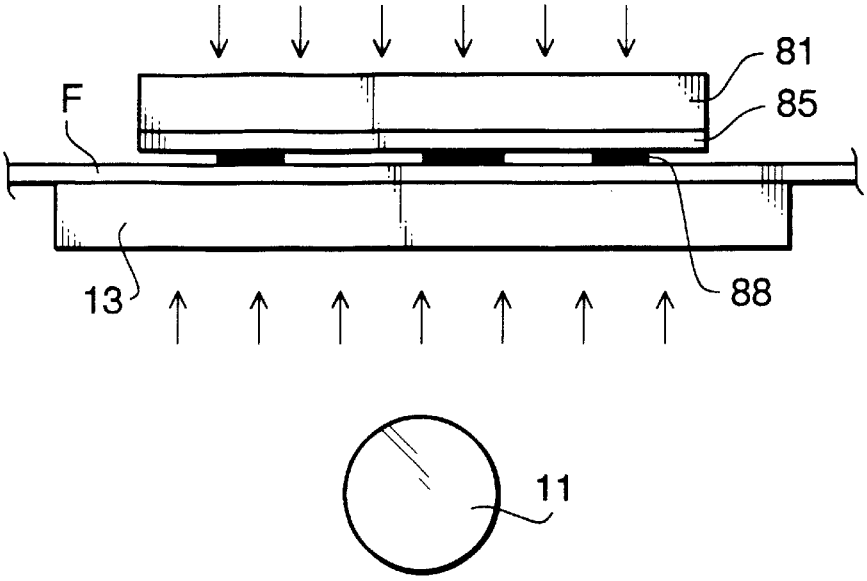
FIG. 22 is a schematic view of an stamp making process of the second embodiment.
Figure 23:
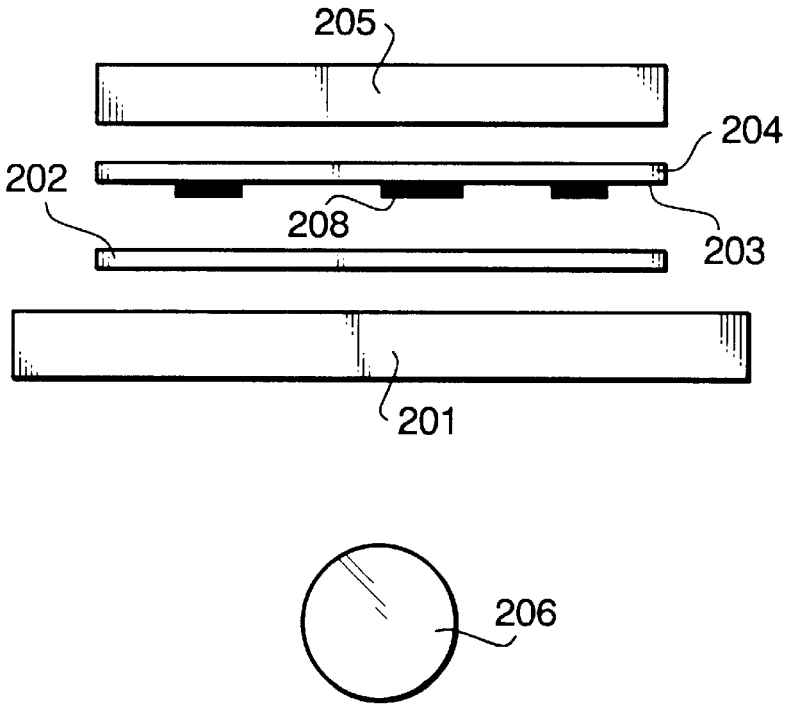
FIG. 23 is a schematic view showing an experiment of a stamp making process of the second embodiment.

FIG. 22 is a schematic view of the stamp making process of the second embodiment. In the second embodiment, S-10120 (product name) manufactured by Tokado Kabushiki Kaisha is employed as the xenon tube 11. The light emitted from this xenon tube 11 is strong enough to melt the lower layer 81*b* including 0.1 to 15 wt % carbon black. In particular, the capacity C of the condenser 211 (FIG. 18) is 8000 $\mu$F, and the voltage V is 330V. The power of the light can be defined as the following equation (1).

$$E=0.5CV^2 \quad (1)$$

The xenon tube 11 has an advantage that the xenon tube is able to repeatedly irradiate light and that the power of the light can be adjusted.

The original film F is not less than 0.019 mm in thickness. As in the first embodiment, the original film F is placed on the transparent support plate 13 made of acrylic plastic in such a manner that a printed image 88 on the original film F is faced with the resin member 81. In this state, the original film F, the printed image 88, the protective film 85, and the resin member 81 are laid on the transparent support plate 13 in this order, as shown in FIG. 22.

The light from the xenon tube 11 passes through the transparent portions of the original film F and the protective film 85, and irradiates the resin member 81. With this, carbon blacks included in the resin member 81 absorb the light (for example, infrared rays) to generate heat. Irradiated portions of the resin member 81 are melted, while non-irradiated portions of the resin member 81 are not melted.

Since the printed image 88 of the original film F is irradiated with the light, the printed image 88 may be heated. However, since the protective film 85 exists between the original film F and the resin member 81, the heat generated by the printed image 88 is diffused in the protective film 85. Thus, the image blurring caused by the unintentional heating of the resin member 81 is prevented.

The heat generated by the printed image 88 may also be transferred to the transparent support plate 13 located beneath the original film F. However, since the original film F has a thickness over 0.019 mm, the heat generated by the printed image 88 is diffused in the original film F. Thus, the heat damage of the transparent support plate 13 is prevented.

An experimental result is described with reference to FIG. 22. A lower PET film 202, an upper PET film 204, and a resin member 205 are laid on a transparent acrylic plate 201. A printed image 208 is formed beneath a lower surface 203 of the upper PET film 204. The upper PET film 204 is made of a PET film "E5001" (product name) manufactured by Toyobo Kabushiki Kaisha, which is 0.025 mm in thickness. The printed image 208 beneath the upper PET film 204 is printed using a black ink of a thermal transfer ribbon "TTM-11" (product name) manufactured by Fujikopian Kabushiki Kaisha. The resin member 205 is made of polyurethane resin including 10 wt % carbon black. The lower PET film 202 is made of "E5001" (product name) manufactured by Toyobo Kabushiki Kaisha. The thickness of the lower PET film 202 is set to 0.016 mm, 0.019 mm, 0.025 mm, 0.038 mm and 0.050 mm. S-1020 (product name) manufactured by Tokado Kabushiki Kaisha is employed as the xenon tube 206. The condition of the emission of the xenon tube 206 is such that the capacity C of the condenser is 8000 $\mu$F, and the voltage V is 330V. Further, the distance between the xenon tube 206 and the acrylic plate 201 is set to 25 mm. Damage to the acrylic plate 201 is checked visually.

The experimental result is shown in Table 1.

TABLE 1

Damage to Acrylic Plate having Different Thicknesses of Lower Pet Film

| Thickness of Lower Pet Film 202 (mm) | 0 | 0.016 | 0.019 | 0.025 | 0.038 | 0.050 |
|---|---|---|---|---|---|---|
| Damage to Acrylic Plate 201 | FOUND | FOUND | NOT FOUND | NOT FOUND | NOT FOUND | NOT FOUND |

Table 1 shows that the acrylic plate 201 suffers no damage if the lower PET film 202 is thicker than 0.019 mm. That is, the heat damage of the acrylic plate 201 can be prevented by providing the lower PET film 202 thicker than 0.019 mm between the ink and the acrylic plate 201. Further, since the upper PET film 204 (with a thickness of 0.025 mm) exists between the resin member 205 and the ink, it is prevented that the heat of the printed image 208 is transferred to the resin member 205. Thus, unintentional heating of the resin member 205 is prevented.

Although the structure and operation of the stamp making device is described herein with respect to the second embodiment, many modifications and changes can be made without departing from the spirit and scope of the invention.

For example, the second embodiment can be applied to a stamp making device which produces a white character on a colored background by means of a negative original. Also, it is possible to replace the xenon tube with a flash bulb. Further, it is possible to provide a transparent sheet on the transparent support plate 13 for protecting the transparent support plate. The transparent support plate 13 can be made of polystyrene or acrylonitrile/butadiene/styrene (ABS) plastic, instead of acrylic plastic.

What is claimed is:

1. A stamp making device which makes a pattern on a porous resin member including light energy absorbing material, said stamp making device comprising:

a data input unit into which image data is inputted;

an original printing unit including a thermal head and a platen which nip a transparent film and an ink ribbon therebetween, said thermal head being driven to print an image on said transparent film based on said image data, thereby to make a positive original film;

an irradiation unit including a transparent support plate fed said original film and a light source which applies light to said porous resin member through said original film;

an original feeder which feeds said original film to said irradiation unit from said original printing unit; and a biasing unit which biases said porous resin member against said original film on said transparent support plate thereby decreasing a thickness of a portion of said porous resin member such that when light is applied by said irradiation unit to said porous resin member through said original film, an irradiated portion of said porous resin member is melted and becomes relatively rigid while an unirradiated portion is relatively elastic and incapable of being impregnated with ink.

2. The stamp making device according to claim 1, wherein a printed surface of said original film is faced with said porous resin member.

3. The stamp making device according to claim 1, wherein a width of said transparent film is greater than a width of said ink ribbon, said original printing unit further comprising a feeding roller pair which nip said transparent film and said ink ribbon therebetween, wherein one of said feeding roller pair located at said ink ribbon side has projections which grip both of said ink ribbon and said transparent film.

4. The stamp making device according to claim 1, further comprising a guiding structure which guides both sides of said original film, wherein said guiding structure extends from said printing unit to said irradiation unit.

5. A stamp making device which makes a pattern on a porous resin member including light energy absorbing material, said stamp making device comprising:

a data input unit into which image data is inputted;

an original printing unit including a thermal head and a platen which nip a transparent film and an ink ribbon therebetween, said thermal head being driven to print an image on said transparent film based on said image data, thereby to make a positive original film;

separation frames adjacent to said original printing unit which lead said ink ribbon and said transparent film in different directions;

an irradiation unit including a transparent support plate fed said original film and a light source which applies light to said porous resin member through said original film;

an original feeder which feeds said original film to said irradiation unit from said original printing unit;

a guiding structure extending from said original printing unit to said irradiation unit, said guiding structure guiding both sides of said original film; and a biasing unit which biases said porous resin member against said original film on said transparent support plate thereby decreasing a thickness of a portion of said porous resin member such that when light is applied by said irradiation unit to said porous resin member through said original film, an irradiated portion of said porous resin member is melted and becomes relatively rigid while an unirradiated portion is relatively elastic and capable of being impregnated with ink.

6. A stamp making device which makes a pattern on a porous resin member including light energy absorbing material, said stamp making device comprising:

a data input unit into which image data is inputted;

an original printing unit including a thermal head and a platen which nip a transparent film and an ink ribbon therebetween, said thermal head being driven to print an image on said transparent film based on said image data, thereby to make an original film;

an irradiation unit including a transparent support plate and a light source;

an original feeder which feeds said original film to said transparent support plate;

a biasing unit which biases said porous resin member against said original film on said transparent support plate, wherein said irradiation unit applies light to said porous resin member through said original film, in a state said biasing unit biases said porous resin member against said original film, so that an irradiated portion of said porous resin member is melted, a cut sheet introducing unit which introduces a cut sheet into between said transparent film and said ink ribbon; and a cut sheet detector which detects if said cut sheet reaches a predetermined portion where said thermal head is able to print an image on said cut sheet, wherein, when said cut sheet detector detects said cut sheet reaching said predetermined portion, said thermal head prints said image on said cut sheet, and wherein, after said image is printed on said cut sheet, said cut sheet is separated from said ink ribbon and said transparent film, and discharged out of said stamp making device.

7. The stamp making device according to claim 6, wherein said cut sheet introducing unit feeds said cut sheet at a lower speed compared with a feeding speed of said transparent film and said ink ribbon.

8. The stamp making device according to claim 6, further comprising a separating unit which separates said cut sheet from said ink ribbon and said transparent film, wherein a separation angle of said cut sheet from each of said ink ribbon and said transparent film is not less than 45 degrees.

9. The stamp making device according to claim 1, further comprising:

a body including a fixed frame and an openable frame opposing with each other, said openable frame being swingable thereby to open said body;

a ribbon cassette accommodating said ink ribbon, a film cassette accommodating said transparent film, a ribbon cassette mounting portion provided in said body, which has at least one shaft extending from said fixed frame toward said openable frame; and a film cassette mounting portion provided in said body, which has at least one shaft extending from said fixed frame toward said openable frame, wherein, when said openable frame is closed, each of said shafts of said mounting portions is supported at both ends thereof by said fixed and openable frames.

10. The stamp making device according to claim 9, further comprising:

an arrangement which moves said platen toward and away from said thermal head thereby to nip and release said ink ribbon and said transparent film; and a lock mechanism which locks said openable frame so that said openable frame does not open when said platen is toward said thermal head.

11. A stamp making device which makes a pattern on a porous resin member including light energy absorbing material, said stamp making device comprising:

a data input unit into which image data is inputted;

an original printing unit including a thermal head and a platen which nip a transparent film and an ink ribbon therebetween, said thermal head being driven to print an image on said transparent film based on said image data, thereby to make an original film;

an irradiation unit including a transparent support plate and a light source;

an original feeder which feeds said original film to said transparent support plate; and a biasing unit which biases said porous resin member against said original film on said transparent support plate, wherein said irradiation unit applies light to said porous resin member through said original film, in a state said biasing unit biases said porous resin member against said original film, so that an irradiated portion of said porous resin member is melted, a first detector which detects if said original film is set on said irradiation unit;

a second detector which detects if said porous resin member is set on said irradiation unit;

a third detector which detects if said porous resin member is biased;

an irradiation prohibit unit which prohibits irradiation by said light source, when a negative result is obtained from any of said detectors.

12. The stamp making device according to claim 11, said light source including a xenon tube, wherein said irradiation prohibit unit prohibits irradiation of said xenon tube when charging of said xenon tube is not completed.

13. The stamp making device according to claim 11, said irradiation unit including a cover which prevents a leakage of light, wherein said irradiation prohibit unit prohibits an irradiation of said light source when a cover is not closed.

14. The stamp making device according to claim 11, further comprising a stamp size detector which detects a size of said stamp mounted on said stamp making device, wherein said stamp size detector determines if said stamp size is suitable for a printed image of said original film.

15. The stamp making device according to claim 14, further comprising a stamp mounting unit which grips said stamp, wherein said stamp size detector detects said stamp size by detecting a position of a moving part of said stamp mounting unit.

16. The stamp making device according to claim 1, wherein a transparent sheet is provided between said porous resin member and said printed image of said original film, wherein a thickness of said transparent sheet is not less than 0.019 mm.

17. The stamp making device according to claim 16, wherein a melting point of said transparent sheet is higher than a melting point of said porous resin member.

18. The stamp making device according to claim 1, wherein said original film is made of a transparent film not less than 0.019 mm in thickness, with an ink image being printed thereon, and wherein said original film is laid on said transparent support plate so that said printed image is faced with said porous resin member.

19. The stamp making device according to claim 18, wherein a melting point of said transparent film is higher than a melting point of said porous resin member.

20. The stamp making device according to claim 19, wherein said transparent support plate is made of acrylic resin, and wherein said transparent sheet is made of polyethylene terephthalate.

21. The stamp making device according to claim 18, wherein said porous resin member is made of polyurethane resin including 0.1 to 15 wt % carbon black, wherein said light source is a xenon tune which is strong enough to melt said porous resin member.

* * * * *